US009683387B2

(12) United States Patent
Lovley, II

(10) Patent No.: US 9,683,387 B2
(45) Date of Patent: Jun. 20, 2017

(54) CANOPY SHELTER LINK POINT

(71) Applicant: BRAVO SPORTS, Sante Fe Springs, CA (US)

(72) Inventor: Jack B. Lovley, II, Lake Forest, CA (US)

(73) Assignee: Bravo Sports, Santa Fe Springs, CA (US)

( * ) Notice: Subject to any disclaimer, the term of this patent is extended or adjusted under 35 U.S.C. 154(b) by 0 days.

(21) Appl. No.: 14/099,188

(22) Filed: Dec. 6, 2013

(65) Prior Publication Data

US 2014/0158176 A1 Jun. 12, 2014

Related U.S. Application Data

(60) Provisional application No. 61/734,887, filed on Dec. 7, 2012.

(51) Int. Cl.
*E04H 15/50* (2006.01)

(52) U.S. Cl.
CPC ..... *E04H 15/50* (2013.01)

(58) Field of Classification Search
CPC ..... E04H 15/50
USPC ..... 135/131, 145, 146
See application file for complete search history.

(56) References Cited

U.S. PATENT DOCUMENTS

| | | | |
|---|---|---|---|
| 33,398 | A | 10/1861 | Miller |
| 292,941 | A | 2/1884 | Nunnelley |
| 574,235 | A | 12/1896 | Bennitt |
| 900,572 | A | 10/1908 | Morton |
| 914,774 | A | 3/1909 | Zimmerman |
| 1,024,176 | A | 4/1912 | Boyens |
| 1,075,372 | A | 10/1913 | Overshiner |
| 1,238,646 | A | 8/1917 | Dennis |
| 1,256,902 | A | 2/1918 | Howe |
| 1,334,048 | A | 3/1920 | Powers |

(Continued)

FOREIGN PATENT DOCUMENTS

| | | |
|---|---|---|
| AU | A 15170/92 | 12/1993 |
| CH | 635 393 | 3/1983 |

(Continued)

OTHER PUBLICATIONS

International Search Report and Written Opinion in co-pending Application No. PCT/US2013/073695, mailed Jul. 29, 2014 in 16 pages.

(Continued)

*Primary Examiner* — David R Dunn
*Assistant Examiner* — Danielle Jackson
(74) *Attorney, Agent, or Firm* — Knobbe Martens Olson & Bear, LLP

(57) ABSTRACT

A canopy shelter link point for increased structural integrity particularly when subject to bending forces about the link point. The canopy shelter link point can include an increased overlap distance between two cross members, reduced spacing between adjacent cross members, and/or extension features located about an end of the cross members to reduce the misalignment angle between two cross members. Such features can be provided using spacers, inserts to be inserted into a cross member and/or sleeves to be placed around the cross member. A reduction in the misalignment angle can reduce the amount of bending forces about the link point.

13 Claims, 16 Drawing Sheets

(56) References Cited

U.S. PATENT DOCUMENTS 1,341,689 A 6/1920 Walmsley
1,429,043 A 9/1922 Martin
1,443,921 A 1/1923 Mackenzie
1,575,902 A 3/1926 Dial
1,593,431 A 7/1926 Buie
1,605,679 A 11/1926 McGrail
1,639,074 A 8/1927 Blackwood
1,666,757 A 4/1928 Snyder
1,763,455 A 6/1930 Bruijn
1,789,090 A 1/1931 Wawrunek
1,846,011 A 2/1932 Adams
1,915,504 A 6/1933 Stokby
2,001,252 A 5/1935 Johnson
2,070,484 A 2/1937 Jones
2,137,427 A 11/1938 Thomson
2,151,908 A 3/1939 Gottlieb
2,166,832 A 7/1939 Wenker
2,243,984 A 6/1941 Singewald
2,265,479 A 12/1941 Goodman
2,429,763 A 10/1947 Lindabury
2,490,367 A 12/1949 Maddocks
2,545,968 A 3/1951 Newstead
2,561,886 A 7/1951 Rikelman
2,571,382 A 10/1951 Raven
2,658,562 A 11/1953 Androsiglio
D171,176 S 12/1953 Yellen
2,689,603 A 9/1954 Smith
2,712,349 A 7/1955 Voir
2,729,276 A 1/1956 Volney
2,747,653 A 5/1956 Obradovich
2,752,929 A 7/1956 Berger
D180,210 S 4/1957 Uretsky
2,819,776 A 1/1958 Balsam
2,849,249 A 8/1958 Fridolph
2,926,724 A 3/1960 Rittenberg
2,989,968 A 6/1961 Gunter
3,007,735 A 11/1961 Cohn
3,034,523 A 5/1962 De Shano
3,085,586 A * 4/1963 McDonough ..... 135/143
3,092,224 A 6/1963 O'Neil
3,151,909 A 10/1964 Gerdetz
3,179,465 A 4/1965 Roberts
3,214,217 A 10/1965 Jente
3,243,230 A 3/1966 Otto
3,307,758 A 3/1967 Platt
3,309,134 A 3/1967 Roberts
3,333,595 A 8/1967 Bannister
3,339,566 A 9/1967 Bowden
3,371,671 A 3/1968 Kirkham
3,404,915 A 10/1968 Filho
3,450,432 A 6/1969 Minsker
3,544,157 A 12/1970 Muller
3,580,633 A 5/1971 Du Priest
3,621,857 A 11/1971 May et al.
3,637,086 A 1/1972 Klein
3,879,086 A 4/1975 Moceri
3,918,109 A 11/1975 Barraclough
3,931,918 A 1/1976 Smith et al.
3,935,874 A 2/1976 Cohen
3,947,903 A 4/1976 Menke
4,029,279 A 6/1977 Nakatani
4,030,748 A 6/1977 Brock
4,047,752 A 9/1977 Rohr
4,063,318 A 12/1977 Nicholson
4,082,102 A 4/1978 Heuer
4,123,095 A 10/1978 Stehlin
4,174,900 A 11/1979 Ina
4,201,416 A 5/1980 Vanderminden
4,248,255 A 2/1981 Arrowsmith
4,251,106 A 2/1981 Gilbert
D261,332 S 10/1981 Rohr
4,293,162 A 10/1981 Pap et al.
4,295,481 A 10/1981 Gee
4,300,798 A 11/1981 Musgrove et al.
4,445,590 A 5/1984 Ihrman
4,487,345 A 12/1984 Pierce et al.
4,497,092 A 2/1985 Hoshino
4,530,451 A 7/1985 Hamilton
4,573,717 A 3/1986 Peacock
4,596,484 A 6/1986 Nakatani
4,635,667 A 1/1987 Harn
4,639,036 A 1/1987 Nichols
4,639,958 A 2/1987 Lerner
4,641,676 A 2/1987 Lynch
4,641,883 A 2/1987 Kato
D289,473 S 4/1987 Myers
4,687,248 A 8/1987 Ross et al.
4,687,249 A 8/1987 Mills
4,736,825 A 4/1988 Belfi
4,744,690 A 5/1988 Hsieh
4,761,092 A 8/1988 Nakatani
4,773,574 A 9/1988 Burgard
4,779,635 A 10/1988 Lynch
4,795,068 A 1/1989 Blean
4,796,734 A 1/1989 Distasic
4,809,724 A 3/1989 Fuser
4,810,029 A 3/1989 Kaladis et al.
4,824,171 A 4/1989 Hollingsworth
4,858,990 A 8/1989 Combs-Rose et al.
4,865,381 A 9/1989 Van Rogue
4,870,984 A 10/1989 Roth
4,885,812 A 12/1989 Lindner
4,889,383 A 12/1989 Jones
4,915,120 A 4/1990 Ziolkowski
4,924,896 A 5/1990 Carter
4,932,622 A 6/1990 Hayakawa
4,949,929 A 8/1990 Kesselman et al.
D310,605 S 9/1990 Kwon
4,971,089 A 11/1990 Braman
4,972,981 A 11/1990 Gex
5,000,210 A 3/1991 Worthington, Jr.
5,013,085 A 5/1991 Craig
5,022,420 A 6/1991 Brim
5,035,253 A 7/1991 Bortles
5,042,874 A 8/1991 Williams
5,080,432 A 1/1992 Connell
5,096,257 A 3/1992 Clark
5,102,190 A 4/1992 Akin et al.
5,135,281 A 8/1992 Pappalardo
5,139,308 A 8/1992 Ziman
5,154,449 A 10/1992 Suei-Long
5,154,473 A 10/1992 Joranco
5,203,363 A 4/1993 Kidwell et al.
5,205,308 A 4/1993 Kendall et al.
5,209,381 A 5/1993 Jay
5,240,020 A 8/1993 Byers
5,244,001 A 9/1993 Lynch
5,244,250 A 9/1993 Nordmeyer
D339,937 S 10/1993 Ryan
5,289,958 A 3/1994 Jay
5,299,337 A 4/1994 Venza
5,303,975 A 4/1994 Asato
5,320,405 A 6/1994 Foster et al.
5,350,215 A 9/1994 DeMars
5,362,130 A 11/1994 Hoffman
5,387,048 A 2/1995 Kuo
5,388,821 A 2/1995 Blackburn
5,395,157 A 3/1995 Rollo et al.
5,421,356 A 6/1995 Lynch
D360,535 S 7/1995 Sjoberg
5,433,502 A 7/1995 Condorodis et al.
5,433,552 A 7/1995 Thyu
5,441,067 A 8/1995 James et al.
5,449,014 A 9/1995 Yan-ho
5,485,863 A 1/1996 Carter
5,490,533 A 2/1996 Carter
5,511,572 A 4/1996 Carter
5,516,193 A 5/1996 Simpson
5,533,654 A 7/1996 Holty et al.
5,538,318 A 7/1996 MacLean
5,538,319 A 7/1996 DiMurro
5,544,793 A 8/1996 Harrop
5,547,246 A 8/1996 Lambert
5,551,110 A 9/1996 Armstrong et al.

(56) References Cited

U.S. PATENT DOCUMENTS 5,551,669 A 9/1996 Reinklou
5,564,452 A 10/1996 Kitchen
5,579,797 A 12/1996 Rogers
5,582,458 A 12/1996 Wildt
5,593,205 A 1/1997 Vanderminden, Sr. et al.
5,593,239 A 1/1997 Sallee
5,597,101 A 1/1997 Barber et al.
5,626,271 A 5/1997 Messey et al.
5,632,292 A 5/1997 Carter
5,634,483 A 6/1997 Gwin
5,638,851 A 6/1997 Baldwin
D380,306 S 7/1997 Lin
D382,126 S 8/1997 Lee
D382,414 S 8/1997 Lee
5,695,100 A 12/1997 O'Brien
5,695,296 A 12/1997 Miura
5,718,473 A 2/1998 Lynch, Jr.
5,722,717 A 3/1998 Rettenberger
5,794,640 A * 8/1998 Jang ..... 135/131
5,797,650 A 8/1998 Gonzalez, Jr. et al.
5,813,425 A 9/1998 Carter
5,819,999 A 10/1998 Tennant
5,833,310 A 11/1998 Labelle
5,873,625 A 2/1999 Uchtman
5,921,258 A 7/1999 Francois
5,934,301 A 8/1999 Carter
5,951,103 A 9/1999 Barnhill
5,961,178 A 10/1999 Hodson
5,967,601 A 10/1999 Gillins
5,975,626 A 11/1999 Aycock
5,984,406 A 11/1999 Lee
6,000,175 A 12/1999 Gale et al.
6,035,877 A 3/2000 Losi, Jr. et al.
6,036,262 A 3/2000 Shahid
6,045,177 A 4/2000 Grace
6,070,604 A 6/2000 Carter
6,082,813 A 7/2000 Chen
6,089,247 A 7/2000 Price
6,095,172 A 8/2000 Trapp et al.
6,102,479 A 8/2000 Wallace
6,112,757 A 9/2000 Tseng
6,129,102 A 10/2000 Carter
6,131,593 A 10/2000 Greene et al.
6,142,699 A 11/2000 Pao
6,148,835 A 11/2000 Rhee
6,152,156 A 11/2000 Tung
6,164,726 A 12/2000 Reeves et al.
6,179,514 B1 1/2001 Cheng
6,206,463 B1 3/2001 Whigham
6,230,729 B1 5/2001 Carter
6,241,311 B1 6/2001 Zheng
6,250,712 B1 6/2001 Livington et al.
6,263,895 B1 7/2001 Bang
6,264,271 B1 7/2001 Munn et al.
6,276,382 B1 8/2001 Bindschatel et al.
6,283,136 B1 9/2001 Chen
6,296,002 B1 10/2001 Tashchyan
6,328,131 B1 12/2001 Backus
6,354,044 B1 3/2002 Lagace, Jr.
6,363,956 B2 4/2002 Carter
6,371,553 B1 4/2002 Tang
6,405,742 B1 6/2002 Driscoll
6,412,507 B1 7/2002 Carter
6,471,289 B2 10/2002 Aguilar
6,478,039 B2 11/2002 Suh
6,508,262 B1 1/2003 Takayama
6,516,821 B1 2/2003 Uemura
6,520,196 B2 2/2003 Carter
6,520,574 B1 2/2003 Huang
6,536,723 B1 3/2003 Nakatani
6,547,324 B1 4/2003 Ammann, Jr.
6,551,226 B1 4/2003 Webber et al.
6,575,656 B2 6/2003 Suh
6,591,849 B1 7/2003 Swetish et al.
6,655,736 B1 12/2003 Arenas
6,672,631 B1 1/2004 Weinhold
6,676,092 B2 1/2004 Tsai
D487,297 S 3/2004 Tyler et al.
6,698,827 B2 3/2004 Le Gette et al.
6,712,083 B2 3/2004 Carter
6,718,995 B2 4/2004 Dotterweich
D494,769 S 8/2004 Vigneaud
6,779,538 B2 8/2004 Morgante et al.
6,789,557 B1 9/2004 Wahl, Jr.
6,823,883 B1 11/2004 Sears
6,824,210 B2 11/2004 Zheng
6,837,642 B1 1/2005 Lin
6,845,780 B2 1/2005 Bishirjian
6,899,383 B2 5/2005 Hwang
6,908,249 B2 6/2005 Tomm
6,913,231 B2 7/2005 Speggiorin
6,926,355 B2 8/2005 Le Gette et al.
6,929,017 B2 8/2005 Byun
6,979,056 B1 12/2005 Goldszer
6,981,510 B2 1/2006 Carter
7,040,832 B2 5/2006 Hsieh
7,044,145 B2 5/2006 Bouchard
7,044,146 B2 * 5/2006 Losi, Jr. ..... 135/145
7,048,333 B2 5/2006 Martinez
D522,605 S 6/2006 Bishirjian
7,066,676 B2 6/2006 Tsai
7,097,380 B2 8/2006 Lee
7,118,172 B1 10/2006 Pattison-Sheets
7,168,759 B2 1/2007 Gallegos Geier
7,198,324 B2 4/2007 Le Gette et al.
7,231,954 B2 6/2007 Green
7,240,685 B2 7/2007 Seo
7,240,687 B2 7/2007 Carter
7,243,990 B1 7/2007 Wahl
7,252,108 B2 * 8/2007 Carter ..... 135/145
7,261,263 B2 8/2007 Baker et al.
7,293,934 B1 11/2007 Huang
7,296,584 B2 11/2007 Goldwitz
7,299,812 B2 11/2007 Carter
7,299,813 B2 11/2007 Ochi
7,302,745 B2 12/2007 Stahle
7,302,957 B2 12/2007 Ross
7,311,355 B2 12/2007 Fargason, III
7,316,450 B2 1/2008 Ayers et al.
7,350,532 B2 4/2008 Wu
7,373,708 B2 5/2008 Stahle et al.
7,374,238 B2 5/2008 Lingwall
7,380,563 B2 6/2008 Seo
7,395,830 B2 7/2008 Seo
7,396,073 B2 7/2008 Zheng
7,409,963 B2 8/2008 Mallookis et al.
7,422,009 B2 9/2008 Rummel et al.
7,422,026 B2 9/2008 Kim
7,427,101 B1 9/2008 Zernov
7,428,908 B2 * 9/2008 Seo ..... 135/145
7,431,389 B2 10/2008 Reeb et al.
7,481,236 B2 1/2009 Carter
7,494,296 B2 2/2009 Stahle
RE40,657 E 3/2009 Suh
7,527,331 B2 5/2009 Fargason, III
7,566,095 B2 7/2009 Reeb et al.
7,568,307 B1 8/2009 Zimhoni et al.
7,637,276 B2 12/2009 Mallookis et al.
D612,624 S 3/2010 Lovley et al.
7,673,643 B2 3/2010 Seo
7,703,469 B2 4/2010 Danzinger
7,735,504 B2 6/2010 Carter
7,753,063 B1 7/2010 Laws
7,753,064 B2 7/2010 Sy-Facunda
7,757,916 B1 7/2010 Petrie et al.
7,775,229 B2 8/2010 Sy-Facunda
7,784,480 B2 8/2010 Sy-Facunda
7,789,099 B2 * 9/2010 Mallookis et al. ..... 135/145
D625,507 S 10/2010 Quinn
7,806,381 B2 10/2010 Sisk Horne et al.
7,836,907 B2 11/2010 Carter
7,849,867 B2 12/2010 Takayama
7,874,303 B2 1/2011 Xie
7,921,864 B2 4/2011 Carter

(56) References Cited

U.S. PATENT DOCUMENTS

| | | | | |
|---|---|---|---|---|
| 7,922,416 | B2 | 4/2011 | Davis et al. | |
| 7,954,272 | B2 | 6/2011 | Potterfield et al. | |
| 7,967,259 | B2 | 6/2011 | Nakatani | |
| 7,975,712 | B2 | 7/2011 | Beacco | |
| 7,980,519 | B2 | 7/2011 | Chen | |
| 7,997,291 | B2 | 8/2011 | Gressette et al. | |
| 8,006,711 | B2 | 8/2011 | Pietrzak et al. | |
| 8,025,455 | B2 | 9/2011 | Huang et al. | |
| D648,148 | S | 11/2011 | Henry | |
| 8,074,669 | B2 | 12/2011 | Collins et al. | |
| 8,075,217 | B2 | 12/2011 | Eason | |
| 8,079,380 | B2 | 12/2011 | Engstrom et al. | |
| 8,091,962 | B2 | 1/2012 | Quinn | |
| 8,128,306 | B2 | 3/2012 | Gorza | |
| 8,162,280 | B2 | 4/2012 | Yu et al. | |
| 8,185,979 | B2 | 5/2012 | Hentschel | |
| 8,186,755 | B2 | 5/2012 | Lovley | |
| 8,191,744 | B2 | 6/2012 | Petrie et al. | |
| 8,220,477 | B2 | 7/2012 | Park | |
| 8,376,646 | B2 | 2/2013 | Melino et al. | |
| 8,408,225 | B2 * | 4/2013 | Mallookis et al. | 135/145 |
| 8,418,711 | B2 | 4/2013 | Park | |
| 8,464,379 | B1 | 6/2013 | Zajac | |
| 8,590,553 | B2 | 11/2013 | Lovley et al. | |
| 8,608,118 | B2 | 12/2013 | Lai | |
| 8,616,226 | B2 | 12/2013 | Ma et al. | |
| 8,746,267 | B2 | 6/2014 | Lovley, II et al. | |
| 8,776,810 | B2 | 7/2014 | Lah et al. | |
| D712,730 | S | 9/2014 | Gridley | |
| 9,072,290 | B1 | 7/2015 | McCauley | |
| D736,884 | S | 8/2015 | Lovley, II et al. | |
| D737,066 | S | 8/2015 | Lovley, II et al. | |
| 9,101,222 | B2 | 8/2015 | Minkoff et al. | |
| 9,103,138 | B2 | 8/2015 | Lovley, II | |
| 9,175,496 | B2 | 11/2015 | Darquea | |
| 9,220,347 | B2 | 12/2015 | Lovley, II et al. | |
| 9,279,269 | B2 | 3/2016 | Lovley, II et al. | |
| 2002/0030146 | A1 | 3/2002 | Akaike | |
| 2002/0112752 | A1 | 8/2002 | Blakney | |
| 2003/0090904 | A1 | 5/2003 | Ching | |
| 2003/0164185 | A1 | 9/2003 | Price | |
| 2004/0084074 | A1 * | 5/2004 | Chiu et al. | 135/131 |
| 2004/0101351 | A1 | 5/2004 | Pitcher | |
| 2004/0178665 | A1 | 9/2004 | May | |
| 2004/0182430 | A1 | 9/2004 | Seo | |
| 2004/0222678 | A1 | 11/2004 | Hansen | |
| 2004/0238021 | A1 | 12/2004 | Holub et al. | |
| 2004/0255997 | A1 | 12/2004 | Seo | |
| 2004/0261828 | A1 | 12/2004 | Jang | |
| 2005/0028856 | A1 | 2/2005 | Seo | |
| 2005/0081904 | A1 | 4/2005 | Suzuki et al. | |
| 2005/0155637 | A1 | 7/2005 | Kim | |
| 2005/0178419 | A1 | 8/2005 | Tseng | |
| 2005/0178422 | A1 | 8/2005 | Wu | |
| 2005/0194030 | A1 | 9/2005 | Goldwitz | |
| 2005/0205124 | A1 | 9/2005 | Goldwitz | |
| 2005/0249545 | A1 | 11/2005 | Tsai | |
| 2006/0051159 | A1 | 3/2006 | Tsai | |
| 2006/0054207 | A1 | 3/2006 | Wootliff | |
| 2006/0062632 | A1 | 3/2006 | Jang | |
| 2006/0096631 | A1 | 5/2006 | Mallookis | |
| 2006/0144434 | A1 | 7/2006 | Chen | |
| 2006/0169311 | A1 | 8/2006 | Hwang | |
| 2006/0174929 | A1 | 8/2006 | Tseng | |
| 2006/0249192 | A1 * | 11/2006 | Tsai et al. | 135/143 |
| 2006/0260666 | A1 | 11/2006 | Choi | |
| 2007/0012346 | A1 | 1/2007 | Choi | |
| 2007/0018486 | A1 | 1/2007 | Ayers et al. | |
| 2007/0040422 | A1 | 2/2007 | Reeb et al. | |
| 2007/0051397 | A1 | 3/2007 | Choi | |
| 2007/0145792 | A1 | 6/2007 | Miller | |
| 2007/0181172 | A1 | 8/2007 | Harrison | |
| 2007/0204897 | A1 | 9/2007 | Habib et al. | |
| 2007/0221263 | A1 * | 9/2007 | Tai | 135/145 |
| 2007/0236058 | A1 | 10/2007 | Yeider | |
| 2007/0240748 | A1 | 10/2007 | Bae | |
| 2008/0035194 | A1 | 2/2008 | Goldwitz | |
| 2008/0087313 | A1 | 4/2008 | Jang | |
| 2008/0121260 | A1 | 5/2008 | Stephens et al. | |
| 2009/0071521 | A1 | 3/2009 | Sy-Facunda | |
| 2009/0087251 | A1 | 4/2009 | Chen | |
| 2009/0218856 | A1 | 9/2009 | Sykes et al. | |
| 2009/0309394 | A1 | 12/2009 | Chen | |
| 2010/0064739 | A1 | 3/2010 | Lu | |
| 2010/0101617 | A1 | 4/2010 | Stehly | |
| 2010/0269877 | A1 | 10/2010 | Sy-Facunda | |
| 2010/0275962 | A1 | 11/2010 | Park et al. | |
| 2011/0023924 | A1 | 2/2011 | Park | |
| 2011/0023925 | A1 | 2/2011 | Johnson et al. | |
| 2011/0073148 | A1 | 3/2011 | Choi | |
| 2011/0181078 | A1 | 7/2011 | Kelly | |
| 2011/0192436 | A1 | 8/2011 | Gridley | |
| 2011/0240078 | A1 | 10/2011 | Lenhart et al. | |
| 2011/0259381 | A1 | 10/2011 | Adams | |
| 2011/0274481 | A1 | 11/2011 | Chen | |
| 2011/0284045 | A1 | 11/2011 | Reeb | |
| 2011/0308559 | A1 | 12/2011 | Ma et al. | |
| 2012/0006373 | A1 | 1/2012 | Stehly | |
| 2012/0034023 | A1 | 2/2012 | Wang et al. | |
| 2012/0107037 | A1 | 5/2012 | Huang | |
| 2012/0146354 | A1 | 6/2012 | Lofley, Sr. et al. | |
| 2012/0175917 | A1 | 7/2012 | Chen | |
| 2012/0305042 | A1 | 12/2012 | Lorbiecki | |
| 2013/0069400 | A1 | 3/2013 | Nikolic | |
| 2013/0247948 | A1 | 9/2013 | Lovley, II et al. | |
| 2013/0284225 | A1 | 10/2013 | Holland et al. | |
| 2014/0174491 | A1 | 6/2014 | Yang | |
| 2014/0283891 | A1 | 9/2014 | Lovley, II et al. | |
| 2014/0306494 | A1 | 10/2014 | Frankel et al. | |
| 2015/0252587 | A1 | 9/2015 | Lovley, II | |
| 2015/0345172 | A1 | 12/2015 | Lovley, II | |

FOREIGN PATENT DOCUMENTS

| | | | |
|---|---|---|---|
| CN | 1104546 | | 4/2003 |
| CN | 2705649 | | 6/2005 |
| CN | 2880991 | | 3/2007 |
| CN | 201216348 | Y | 4/2009 |
| CN | 102022609 | A | 4/2011 |
| CN | 202055611 | U | 11/2011 |
| CN | 202706662 | U | 1/2013 |
| CN | 2545298 | | 4/2013 |
| DE | 26 55 028 | A1 | 6/1978 |
| DE | 31 31 166 | A1 | 2/1983 |
| DE | 35 360 49 | A1 | 4/1987 |
| DE | 42 01 743 | A1 | 10/1992 |
| DE | 10 2010 049 941 | | 5/2012 |
| EP | 0 564 326 | | 10/1993 |
| FR | 532 496 | A | 2/1922 |
| FR | 2 691 619 | | 12/1993 |
| FR | 2 805 559 | | 8/2001 |
| GB | 2 052 960 | A | 2/1981 |
| GB | 2 091 648 | | 8/1982 |
| GB | 2 216 850 | | 10/1989 |
| JP | 58-129855 | | 9/1983 |
| JP | 61-7351 | | 1/1986 |
| JP | 7 207 962 | | 8/1995 |
| JP | 3059720 | | 7/2000 |
| JP | 2001-003604 | | 1/2001 |
| JP | 2001-254535 | | 9/2001 |
| JP | 2002-209663 | | 7/2002 |
| JP | 2005-290837 | | 10/2005 |
| JP | 2011-144606 | | 7/2011 |
| KR | 10-2002-0048191 | | 6/2002 |
| KR | 10-2004-0023115 | | 3/2004 |
| KR | 20060001341 | | 1/2006 |
| KR | 10-0886118 | | 2/2009 |
| KR | 10-2011-0054253 | | 5/2011 |
| KR | 10-2014-0135004 | | 11/2014 |
| SU | 1174551 | | 8/1985 |
| WO | WO 82/01984 | | 6/1982 |
| WO | WO 91/14386 | | 10/1991 |
| WO | WO 94/23162 | | 10/1994 |

(56) References Cited

FOREIGN PATENT DOCUMENTS

| | | |
|---|---|---|
| WO | WO 96/39066 | 12/1996 |
| WO | WO 2005/024158 | 3/2005 |
| WO | WO 2007/018926 | 2/2007 |

OTHER PUBLICATIONS

U.S. Appl. No. 60/467,698, filed May 1, 2003, Churchill.
Photographs of overlapping eaves systems which may have been publicly disclosed and/or sold by the Assignee of the present Application or by parties other than the Assignee as early as Dec. 7, 2011.

* cited by examiner

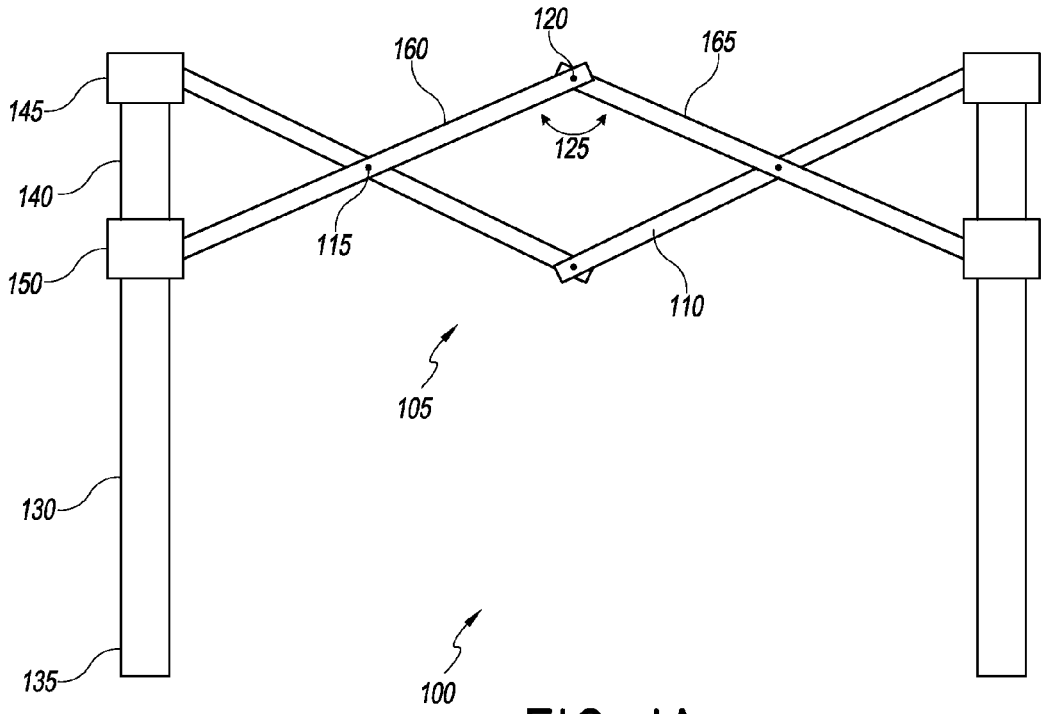
FIG. IA
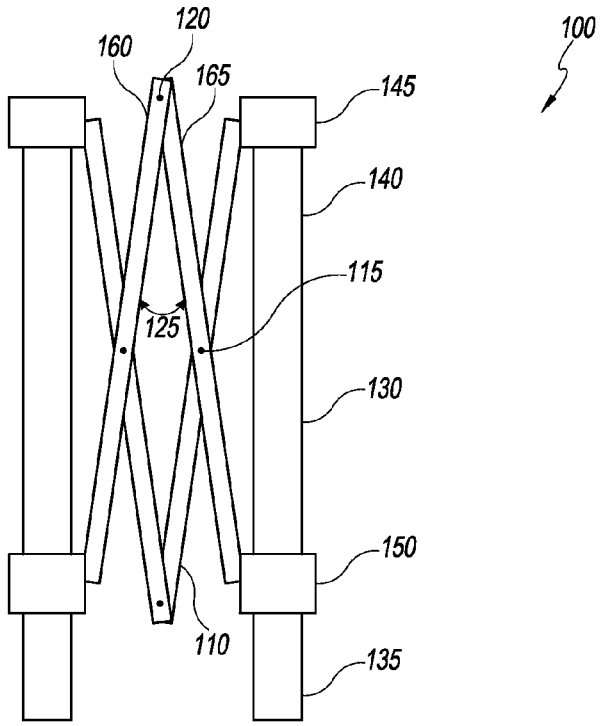
FIG. IB

CANOPY SHELTER LINK POINT

INCORPORATION BY REFERENCE TO PRIORITY APPLICATION

The present application claims priority to U.S. Provisional Application No. 61/734,887 filed Dec. 7, 2012, entitled CANOPY SHELTER LINK POINT, the entire contents of which are hereby expressly incorporated by reference herein and made a part of the present disclosure.

BACKGROUND OF THE INVENTIONS

Field of the Invention

The present invention relates to collapsible canopy frames and, in particular, canopy frames having improved link points.

Description of the Related Art

Canopy shelters with collapsible frames are commonly used to provide portable shelter for outdoor activities such as camping, picnicking, parties, weddings, and more. Such collapsible canopy shelters typically comprise a canopy cover and a canopy frame configured to stand alone when in an expanded or deployed state and to collapse into a collapsed state for storage and transport.

While conventional canopy shelters are useful for a variety of purposes, such as providing portable shade and/or shelter from the elements and providing an aesthetically pleasing backdrop for special events, conventional canopy frames leave room for improvement with respect to structural integrity. Some conventional canopy frame designs are vulnerable to severe weather and human or animal interference and are prone to bending, particularly at the link point of the cross members.

Cross members are pivotally coupled at a cross points and link points. The link point consists of overlapping cross members, through bolted and pivotally coupled to each other near the end of each cross member. Cross members may also be pivotally coupled at a cross point, occurring at approximately the midpoint of each cross member. Generally, to reduce the level of friction created by the link point and allow the cross members to pivot freely, a spacer will be placed between the cross members at link points and cross points.

SUMMARY OF THE INVENTIONS

The systems, methods and devices described herein have innovative aspects, no single one of which is indispensable or solely responsible for their desirable attributes. Without limiting the scope of the claims, some of the advantageous features will now be summarized.

One aspect of the present invention is the realization that the spacer placed between the cross members at the link point creates a space between the cross members, allowing them to bend relative to one another, creating unwanted flexibility in the canopy frame and producing additional stresses at each link point. This flexibility reduces the structural integrity of the frame and sometimes leads to canopy frame bending or failure. Thus, there exists a need for an improved link point design.

One non limiting embodiment of the present invention includes an extended cross member providing an extended overlapping distance and decreasing the amount of misalignment possible and thus the misalignment angle between the left cross member and right cross member when the canopy frame is in an expanded state.

Another non limiting embodiment of the present invention includes an enlarged head cross member insert configured to bridge some or all of the gap between the left cross member and right cross member, thus decreasing the amount of misalignment possible and thus the misalignment angle between the left cross member and right cross member when the canopy frame is in an expanded state.

Another non limiting embodiment of the present invention includes a sleeve with a partially spanning projection configured to bridge some or all of the gap between the left cross member and the right cross member in an expanded state and allow the canopy frame to achieve a collapsed state without having the projection on the sleeve of the left cross member interfere with the projection on the sleeve of the right cross member. Another non limiting embodiment includes a linkage system for a collapsible frame having a collapsed state and an expanded state, the system including a first and second cross member assembly pivotably coupled about a link point axis at a link point, each cross member assembly having a first end, a second end, an inner surface and an outer surface, wherein at least one of the first and second cross member assemblies includes an extension feature located about the first end of the cross member assemblies, the extension feature projecting outwardly from the outer surface of the cross member assembly an extension distance towards the opposing cross member assembly when the first and second cross members are pivotably coupled, wherein the outer surfaces of the first cross member assembly and the second cross member assembly are spaced apart a spacing distance when pivotably coupled in an expanded state, and wherein the coupling point is spaced apart from the first end of the first cross member assembly an overlap distance.

In some embodiments, at least one of the first and second cross member assemblies further includes an insert, the insert having a body portion, the body portion being sized and shaped to be placed within the inner surface of a cross member of the cross member assembly and a head portion forming the first end of the cross member assembly, the head portion having an outer periphery forming the extension feature of the cross member assembly. In some embodiments, the linkage system can further include a spacer placed between the first and second cross member assemblies at the link point.

In some embodiments, at least one of the first and second cross member assemblies further includes a sleeve, the sleeve having a shell portion with an inner surface and an outer surface, the inner surface of the shell portion being sized and shaped to be placed on the outer surface of a cross member of the cross member assembly, and a projection, the projection forming the extension feature. In some embodiments, the sleeve can also include a spacing projection about the link point. In some embodiments, the projection can span partially across a long side of the sleeve

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

FIGS. 1A-1B illustrate front plan views of one type of collapsible canopy frame in expanded and collapsed positions, respectively.

DETAILED DESCRIPTION OF EMBODIMENTS

Figure 2A:
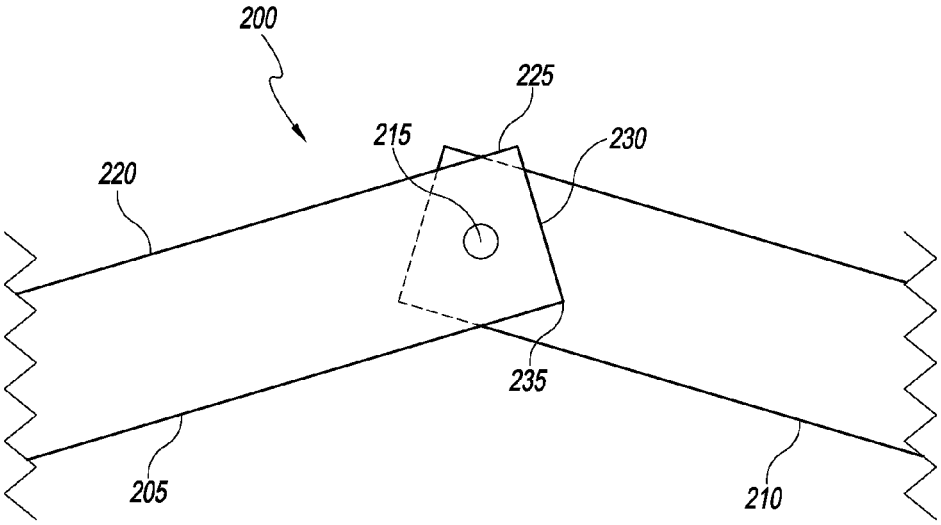
FIGS. 2A and 2B illustrate front plan views of a left cross member and a right cross member pivotally coupled at a link point.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of the inventive features illustrated herein, and additional applications of the principles of the inventions as illustrated herein, which would occur to one skilled in the relevant art and having possession of this disclosure, are to be considered within the scope of the invention.

Descriptions of unnecessary parts or elements may be omitted for clarity and conciseness, and like reference numerals refer to like elements throughout. In the drawings, the size and thickness of layers and regions may be exaggerated for clarity and convenience.

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description of the Preferred Embodiments" one will understand how illustrated features serve to explain certain principles of the present disclosure.

FIGS. 1A-1B illustrate a front plan view of one type of collapsible canopy frame 100. In one embodiment, the canopy frame 100 comprises a plurality of eaves 105 linking a plurality of upwardly extending poles 130. Each eave 105 may comprise a series of cross members 110 crossed and pivotally coupled at cross points 115 and link points 120. Each eave 105 may be collapsibly coupled to a pair of upwardly extending poles 130 through two fixed eave mounts 145 and two sliding eave mounts 150. Fixed eave mounts 145 may be fixably coupled to the top ends 140 of upwardly extending poles 130, and sliding eave mounts 150 may be slidably coupled to poles 130, such that sliding eave mounts 150 slide over the length of upwardly extending poles 130 from at or near the bases of poles 135 to just below fixed eave mounts 145. In turn, cross members 110 may be coupled to the fixed eave mounts 145, other cross members 110 may be coupled to the sliding eave mounts 150, and the cross members 110 may be fixed to one another, allowing the canopy frame 100 to collapse like an accordion when one or more of the sliding eave mounts 150 are released and slid in a downward direction toward the base of the pole 135. FIG. 1A illustrates the collapsible canopy frame 100 in an expanded state and FIG. 1B illustrates the collapsible canopy frame 100 in a collapsed state.

One of ordinary skill in the art will readily understand that several alternative mechanisms could be used to collapsibly couple eaves 105 to upwardly extending poles 130. For example, eaves 105 could be coupled to upwardly extending poles 130 through locking channel systems or a quick release system (not illustrated). In addition, the eaves 130 may comprise any number of cross members 110 depending on the size of the canopy and other characteristics of the collapsible canopy shelter. One example of an increased number of cross members is included in US Patent Publication 2009/0071521 to Sy-Facunda, herein incorporated by reference.

Figure 2B:
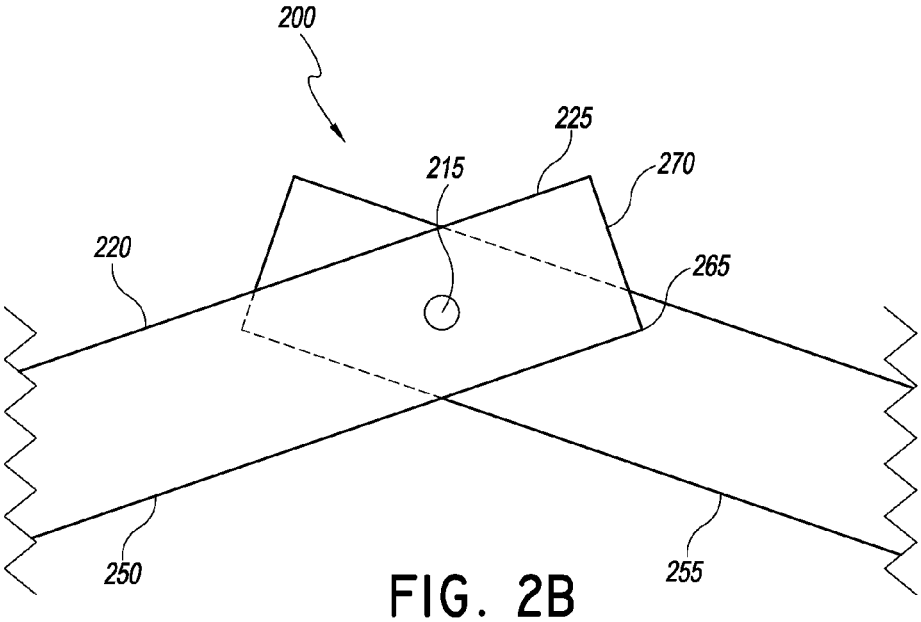
Figure 2C:
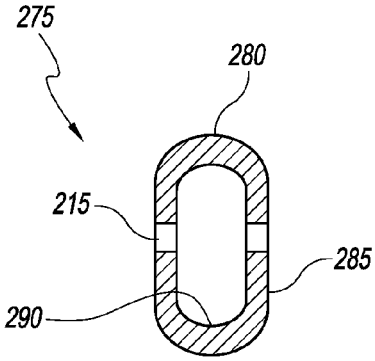
FIG. 2C illustrates a cross section view of a cross member.

FIGS. 2A and 2B illustrate a front plan view of a left cross member 205, 250 and a right cross member 210, 255 pivotally coupled at a link point 200. FIG. 2C illustrates a cross section view of a cross member 275. In one embodiment each cross member 275 consists of a hollow ovular tube with two long sides 285 and two short sides 280. In other embodiments the tube may be square, rectangular, circular, elliptical, or any combination thereof. Any of the cross members discussed herein may include the cross sections discussed above. In one embodiment, referring to FIGS. 2A and 2B, near at least one end of each cross member 205, 210 is a link point 200 where each cross member 205, 210 has a hole 215 formed therethrough. In a preferred embodiment, the hole 215 is formed through both long sides 285 of each cross member 275. The hole 215 allows a fastener to be installed through both the left cross member 205 and right cross member 210, pivotally coupling them at the link point 200.

Figure 3A:
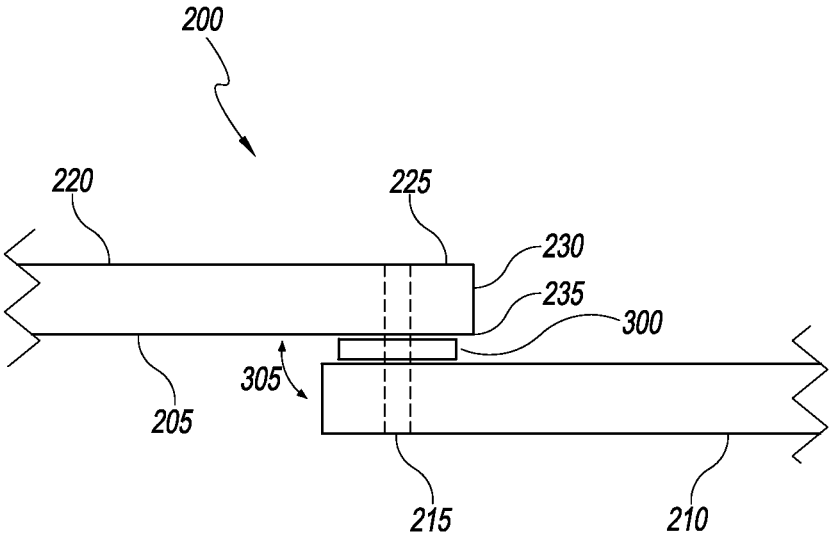
FIGS. 3A and 3B illustrate top views of a link point.
Figure 3B:
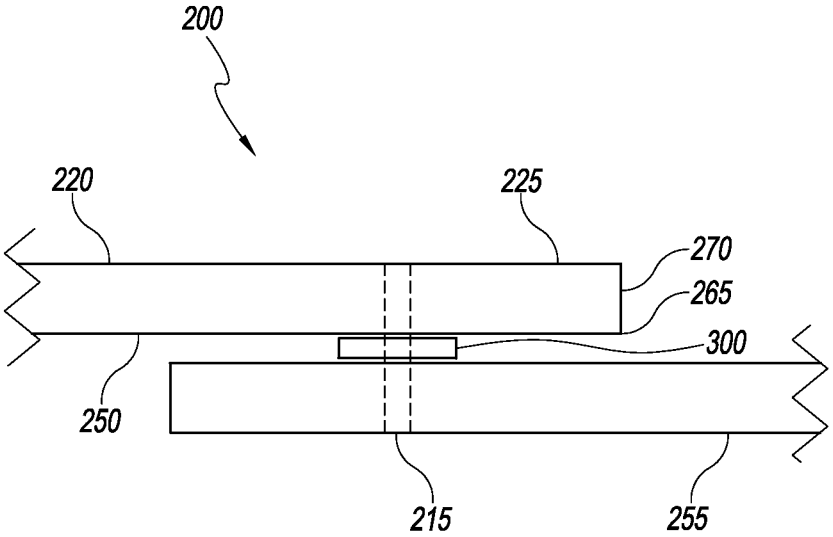

FIGS. 3A and 3B illustrate a top view of a link point 200. In one type of canopy frame 100, a spacer 300 is placed between the left cross member 205 and right cross member 210 to reduce the level of friction created by the link point 200 and allow the cross members 205, 210 to pivot freely. The spacer 300 may be a washer for example, a circular flat piece of material with a hole formed therein to allow a fastener to pass through. In various situations, including for example during expansion or collapse of the canopy frame, or during inclement weather, the canopy frame 100 may see loads in a multitude of directions. In some situations a bending force (e.g., force having a component aligned with the axis of hole 215) may be seen by the link point 200 when forces cause the left cross member 205 and right cross member 210 to misalign. For example, in FIG. 3A, the far end 220 of the left cross member 205 may bend upwards while the far end of the right cross member 210 bends downwards. The spacer 300 creates a space between the left cross member 205 and the right cross member 210, which allows additional misalignment between the left cross member 205 and right cross member 210, increasing the stress at the link point 200, sometimes leading to deformation, weakening, or failure of the canopy frame 100. Therefore, it is advantageous to avoid such misalignment or at least minimize the misalignment angle 305 illustrated in FIGS. 3A and 3B, which is measured about an axis perpendicular to the link point axis about which the link point angle, illustrated in FIGS. 1A and 1B, is measured.

In one embodiment, as illustrated in FIG. 2B and FIG. 3B, the tip distance between the center of the hole 215 and the tip 270 of the close end 225 of each cross member 250, 255 can be increased beyond the length of conventional cross members. In one embodiment, the tip distance may be increased beyond the length necessary to accommodate the spacer 300. In some configurations, the tip distance could be at least 2 to 5 times the radius of spacer 300 or more. In some embodiments, the outer radius of the spacer 300 can be between about 5 millimeters to 15 millimeters, between about 5 millimeters to about 10 or any other outer radius within this range. Accordingly, the tip distance may be between 20 and 60 millimeters It is generally preferable to reduce the total contact surface between the spacer 300 and the two cross members 250, 255 to reduce friction of the link point 200. This can advantageously facilitate conversion of the device from a collapsed state to an expanded state and from the expanded state to the collapsed state. Accordingly, in some embodiments, the spacer 300 can have an outer diameter of 14 millimeters and an inner diameter of 6 millimeters. This can be used, for example, to allow a fastener, having a diameter of approximately 6 millimeters to be passed therethrough. In some embodiments, the spacer 300 can have an outer diameter of 13 millimeters and an inner diameter of 4 millimeters. These spacers can have thicknesses between about 0.1 millimeters to about 2.0 millimeters, between about 0.5 millimeters to about 1.5 millimeters, about 0.5 millimeters, about 1.0 millimeters, about 1.5 millimeters, and any other thickness within this range.

As illustrated in FIGS. 1A and 1B, the link point angle 125 formed by the left cross member 160 and the right cross member 165 at the link point can vary between an expanded state and a collapsed state. When the canopy frame 100 is in an expanded state, as illustrated in FIG. 1A, the link point angle 125 between the left cross member 160 and the right cross member 165 may be between 100 and 175 degrees. When the canopy frame 100 is in a collapsed state, as illustrated in FIG. 1B, the link point angle 125 may be between 0 and 30 degrees.

FIGS. 2A and 2B illustrate the left cross member 205, 250 and right cross member 210, 255 pivotally coupled at a link point 200 when the canopy frame 100 is in an expanded state. In an expanded state, the close end 225 of the left cross member 204 overlaps with at least a portion of the right cross member 210 and vice versa. By increasing the tip distance between the center of the hole 215 and the tip 230, 270 of each cross member 205, 250, the overlapping distance between the hole 215 and the furthest overlapping point 235, 265 increases accordingly as illustrated in FIG. 3A versus FIG. 3B. In one embodiment, the increased tip distance and resulting increased overlapping distance creates a potential point of contact between the left cross member 250 and right cross member 255 at a location spaced a significant distance from the hole 215, such as at or near each cross member's furthest overlapping point 265. The extended overlapping distance decreases the amount of misalignment possible and thus the misalignment angle 305 between the left cross member 250 and right cross member 255 when the canopy frame 100 is in an expanded state. The decreased amount of misalignment reduces the stress at the link point 200, thus increasing the structural integrity of the canopy frame 100 and reducing the chance of deformation, weakening, or failure of the link point 200. Any of the cross members discussed herein include an increased tip distance as discussed above.

Figure 4A:
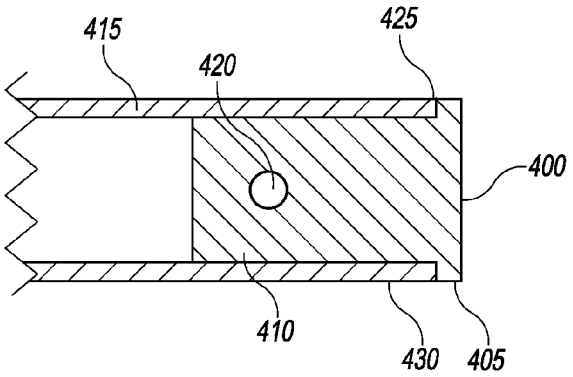
FIG. 4A illustrates a front section view looking towards a long side of a cross member and insert.
Figure 4B:
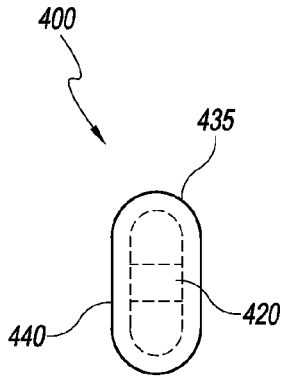
FIG. 4B illustrates an end view of an insert.
Figure 5A:
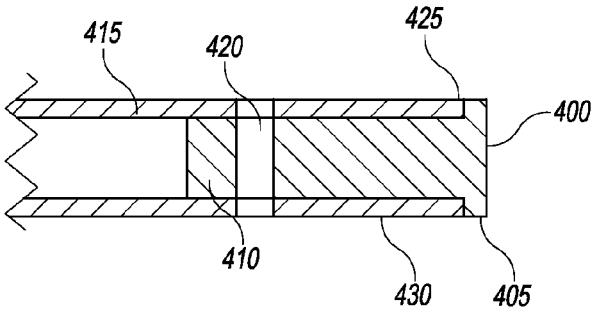
FIG. 5A illustrates a top section view looking towards a short side of a cross member and insert.
Figure 5B:
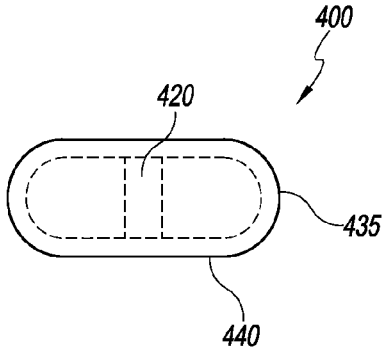
FIG. 5B illustrates an end view of an insert.

FIG. 4A illustrates a front section view looking towards a long side 440 of a cross member 415 and insert 400. FIG. 4B illustrates an end view of an insert 400. FIG. 5A illustrates a top section view looking towards a short side 435 of a cross member 415 and insert 400. FIG. 5B illustrates an end view of an insert 400. In one embodiment, an insert 400 is installed in the close end 430 of a cross member 415. The insert 400 comprises a body portion 410 and a head portion 405. The body portion 410 of the insert 400 is configured to fit within the inner surface 290 (See FIG. 2C) of the hollow cross member 415. The head portion 405 is configured to abut the tip 425 of the cross member 415 and not fit within the cross member 415. In one embodiment, the outside surface of the body portion 410 of the insert 400 is configured to follow the contour of the inside surface of the cross member 415. In one embodiment, the insert 400 may be configured to slide easily into the close end 430 of the cross member 415. In another embodiment, the insert 400 may be configured to snugly fit within the inside of the cross member 415. In another embodiment, the insert 400 and the cross member 415 may constitute an interference fit where the body portion 410 of the insert 400 is larger than the inner surface 290 of the cross member 415, requiring force to install the insert 400 into the cross member 415. In one embodiment, the increased dimension of the insert 400 may only occur on the long sides 440 of the body portion 410 of the insert 400. In one embodiment, the distance between each long side 440 of the body portion 410 of the insert 400 may be approximately 0.1 to 1.0 millimeters greater than the distance between the inner surface 290 of each long side 285 of the cross member 415.

In one embodiment the body portion 410 of the insert 400 extends at least past the hole 215 formed through the cross member 275. The insert has a hole 420 formed therethrough configured to align with the hole 215 through the cross member 275 so that a fastener 725 can pass through both the cross member 275 and the insert 400. The body portion 410 of the insert 400 fills the space between the inner surfaces 290 of the cross member 275, increasing the strength of the cross member 275 and preventing the walls from pinching inwards when the fastener 725 is tightened down at the link point 700. The increased strength allows for increased torque to be applied to the fastener 725 during assembly, and thus creates a more structural joint at the link point 700, increasing structural rigidity of the canopy frame 100 and reducing the likelihood of failure.

Figure 6A:
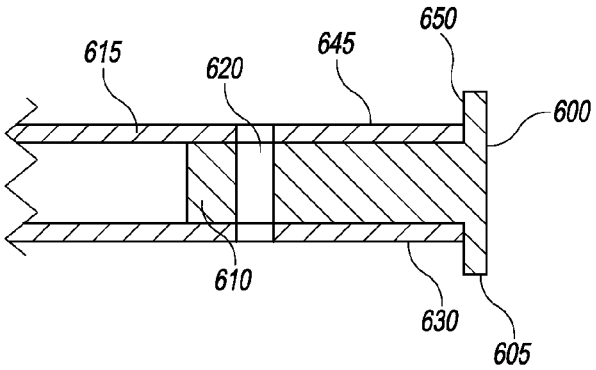
FIG. 6A illustrates a top section view looking towards a short side of a cross member and enlarged head insert.
Figure 6B:
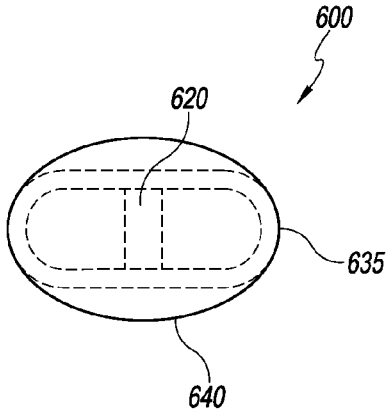
FIG. 6B illustrates an end view of an enlarged head insert.

FIG. 6A illustrates a top section view looking towards a short side 635 of a cross member 615 and enlarged head insert 600. FIG. 6B illustrates an end view of an enlarged head insert 600. In one embodiment, the enlarged head portion 605 of the enlarged head insert 600 extends beyond the outer surface 645 of the cross member 615. In one embodiment, as illustrated in FIGS. 6A and 6B, the extension 650 is preferably located only on the long sides 640 of the insert 600.

Figure 7:
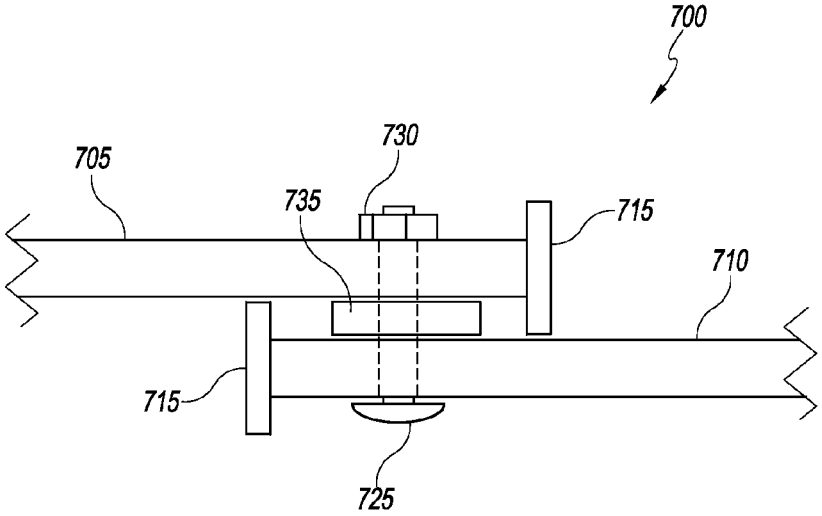
FIG. 7 illustrates a top view of a link point with enlarged head inserts installed in the cross members.

FIG. 7 illustrates a top view of a link point 700 with enlarged head inserts 715 installed in the cross members 705, 710. As shown in the illustrated embodiment, the enlarged head insert 715 can bridge a portion or substantially all of the gap between the left cross member 705 and the right cross member 710, thus decreasing the amount of misalignment possible and thus the misalignment angle 305 between the left cross member 705 and right cross member 710 when the canopy frame 100 is in an expanded state. The decreased amount of misalignment reduces the stress at the link point 700, thus increasing the structural integrity of the canopy frame 100 and reducing the chance of deformation, weakening, or failure of the link point 700. In one embodiment, the enlarged head portion 605 protrudes approximately 1 to 20 millimeters past the outer surface 645 of the cross member 615 in a lateral direction or a direction aligned with the axis of the hole 620. In one embodiment, the enlarged head portion 605 protrudes approximately 1 to 10 millimeters past the outer surface 645 of the cross member 615. In one embodiment, the enlarged head portion 605 protrudes approximately 2 to 3 millimeters past the outer surface 645 of the cross member 615. In one embodiment, the enlarged head portion 605 protrudes approximately 2.5 millimeters past the outer surface 645 of the cross member 615. In one embodiment, the distance measured from the outermost portion of one long wall of the enlarged head portion 605 to the outermost portion of the opposite long wall of the enlarged head portion 605 is between approximately 10 millimeters and 15 millimeters. In one embodiment, this distance can be approximately 12 millimeters and 13 millimeters. In one embodiment, this distance can be approximately 12.5 millimeters. In another embodiment, the enlarged head portion 605 of the enlarged head insert 600 may only extend past the outside surface 645 of the cross member 615 on the side of the cross member which is closest to the other cross member (not illustrated).

Figure 8A:
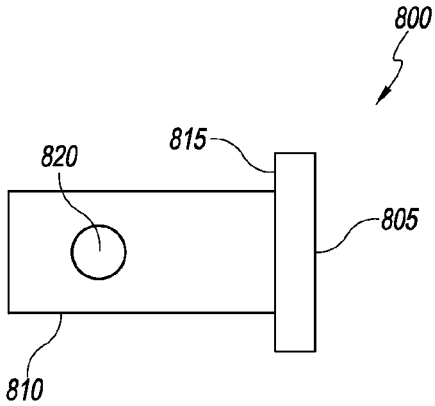
FIG. 8A illustrates a front view of a solid enlarged head insert. In one embodiment, the insert comprises one solid piece with a hole formed therethrough.

FIG. 8A illustrates a front view of a solid enlarged head insert 800. In one embodiment, the solid enlarged head insert 800 comprises one solid piece with a hole 820 formed therethrough.

Figure 8B:
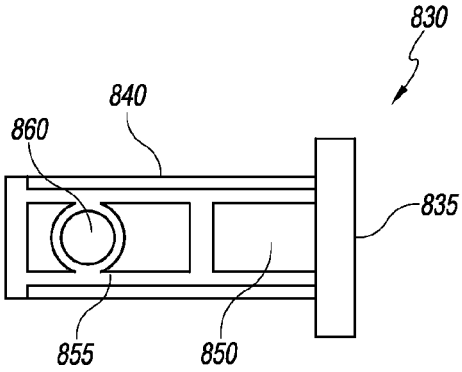
FIG. 8B illustrates a front view of a reinforced enlarged head insert.

FIG. 8B illustrates a front view of a reinforced enlarged head insert 830. In a preferred embodiment, the reinforced enlarged head insert 830 comprises an alternative construction including reinforcing ribs 855 and cavities 850. The reinforced structure reduces the amount of material necessary to manufacture the reinforced enlarged head insert 830, decreases the weight of the reinforced enlarged head insert 830, all without significantly reducing the strength of the reinforced enlarged head insert 830. The cavities 850 can pass partially or completely through the insert 830.

Figure 8E:
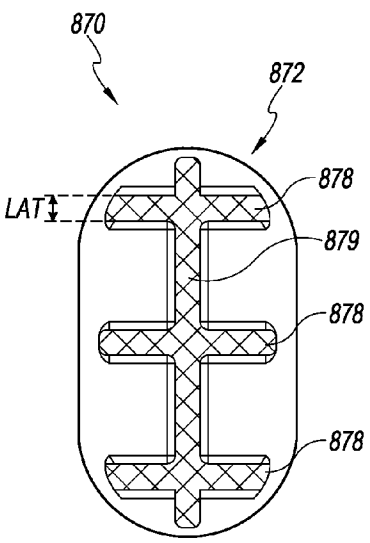
FIG. 8E illustrates a cross section of the insert of FIG. 8C along line "8E."
Figure 8C:
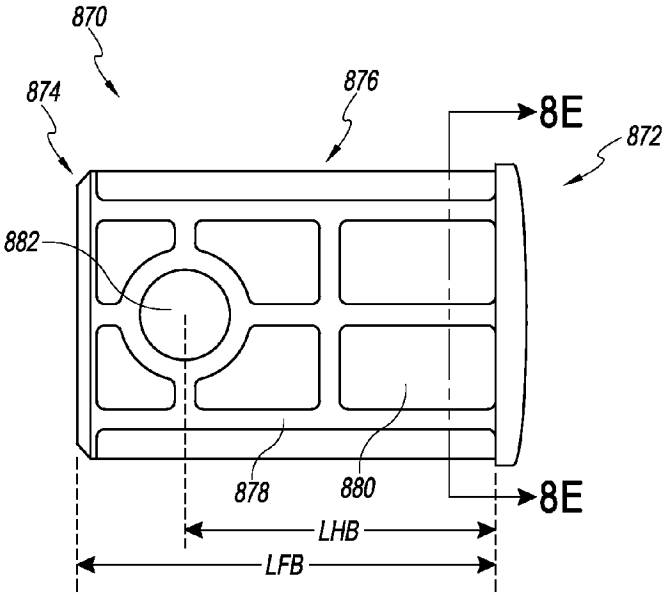
FIG. 8C illustrates a side view of an insert.
Figure 8D:
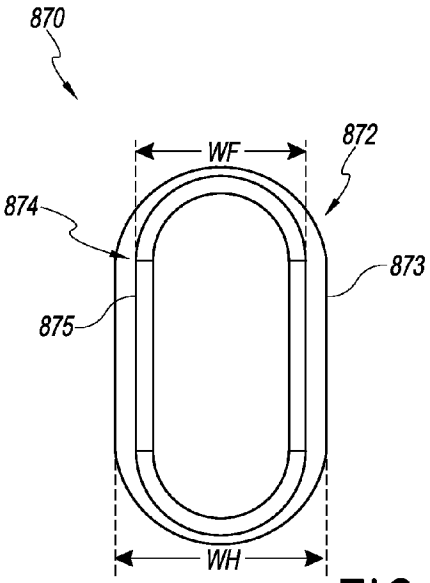
FIG. 8D illustrates a front view of the insert of FIG. 8C.

FIGS. 8C-8E illustrates a front view of an enlarged head insert 870 having a head portion 872, a foot portion 874, a body portion 876 including ribs 878, 879 and cavities 880, and a hole 882. As illustrated in FIG. 8C, in some embodiments, the head portion 872 can have a rounded shape. This rounded shape can reduce the presence of sharp edges of the portion of the insert 870 protruding out of the cross member. Furthermore, as shown more clearly, in FIG. 8D, the head portion 872 can have an outer periphery 873 having a semi-circular top and bottom portion. The general shape of the outer periphery 873 can be similar to that of the shape of an outer surface of the cross member. As discussed above, in some embodiments, the outer periphery 873 can be sized and shape to extend beyond the outer surface of the cross member such that the head portion 872 forms extensions, such as extension 650. Furthermore, the outer periphery 873 need not extend past the outer surface of the cross member in all directions.

In some embodiments, the width "WH" of the head portion 872, can be between about 10 millimeters to about 30 millimeters, between about 10 millimeters to about 20 millimeters, about 12.5 millimeters, and any other width within this range. Furthermore, in some embodiments, the radius of the rounded portions of the outer periphery 873 can be between about 4 millimeters to about 15 millimeters, between about 5 millimeters to about 10 millimeters, about 6.25 millimeters, and any other radius within this range.

Furthermore, as shown more clearly in FIG. 8D, the insert 870 can have a foot portion 874 at the opposite end of the body portion 876. In some embodiments, the foot portion 874 can have a shape which corresponds to the shape of the inner surface, such as inner surface 290, of the cross member. In some embodiments, a substantial portion of the outer periphery 875 of the foot portion 874 can be sized and shaped to contact the inner surface of the cross member. For example, as shown in the illustrated embodiment, the outer periphery 875 can have a semi-circular top and bottom portion.

In some embodiment, the width "WF" of the foot portion 874, can be between about 5 millimeters to about 25 millimeters, between about 7 millimeters to about 15 millimeters, about 10 millimeters, and any other width within this range. Furthermore, in some embodiments, the radius of the rounded portions of the outer periphery 875 can be between about 3 millimeters to about 15 millimeters, between about 5 millimeters to about 10 millimeters, about 5 millimeters, and any other radius within this range.

In some embodiments, the body 876 of the insert 870 can include reinforcing ribs 878, 879 and cavities 880. As discussed above in connection with FIG. 8B, use of reinforcing ribs 878, 879 can reduce the amount of materials used for the insert 870 without significantly reducing the structural integrity of the insert 870. Accordingly, the insert 870 can have a reduced weight and potentially be more inexpensive to manufacture. In some embodiments, the ribs 878, 879 can have a thickness between about 1 millimeter and about 2 millimeters. In some embodiments, certain of ribs 878, 879 can have a thickness different from other of other ribs 878, 879. For example, in some embodiments, laterally-extending ribs 878 can have a thickness "LAT" of about 1.5 millimeters whereas a longitudinally extending rib 879 can have a thickness of about 1.3 millimeters.

In some embodiments, the hole 882 can have a radius between about 2 millimeters to about 10 millimeters, between about 3 millimeters to about 8 millimeters, about 3.25 millimeters, and any other radius within this range. Furthermore, in some embodiments, the distance "LHB" between the hole 882 and the end of the body portion 876 can be between about 10 millimeters to about 80 millimeters, between about 20 millimeters to about 30 millimeters, about 23 millimeters, and any other distance within this range. In some embodiments, the length "LFB" of the foot portion 874 and body portion 876 can be between about 20 millimeters to about 100 millimeters, between about 20 millimeters to about 40 millimeters, about 31 millimeters, and any other distance within this range.

Figure 9:
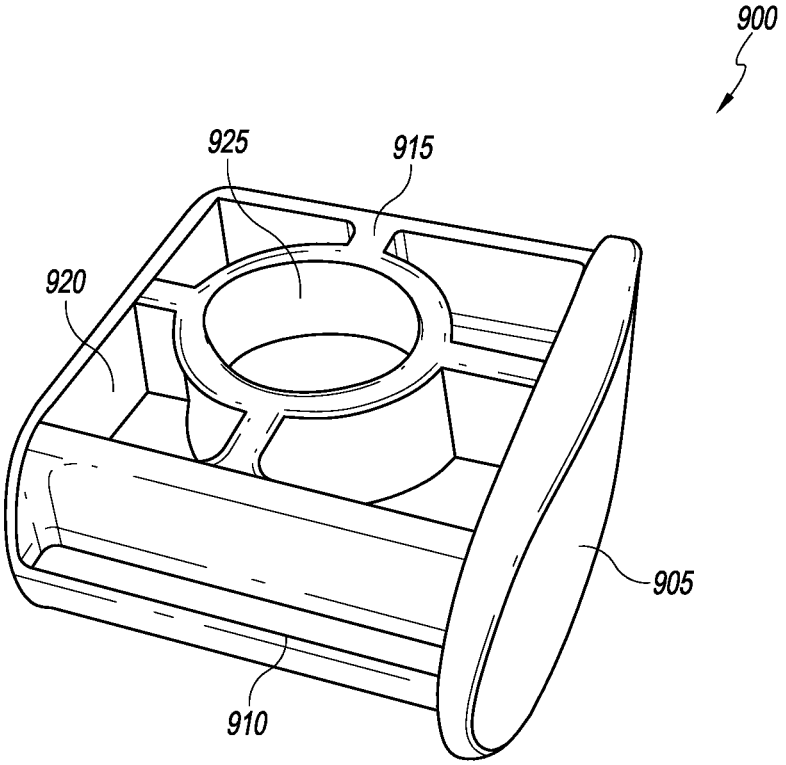
FIG. 9 illustrates one embodiment of a reinforced insert.

FIG. 9 illustrates one embodiment of a reinforced insert 900. The reinforced insert 900 comprises a head portion 905, a body portion 910, a hole 925 formed therethrough, reinforcing ribs 915, and cavities 920. In some embodiments, the insert may be configured to have an interference fit or an enlarged head without necessarily having an extended length. In one embodiment, the insert 400, 600, 715, 800, 830, 870 may be constructed of an assortment of materials, for example, rubber, plastic, thermoplastic, thermoset, acrylonitrile butadiene styrene, polycarbonate alloy, acetal, acrylic, nylon, polybutylene terephthalate, polyester liquid crystal polymer, polypropylene, polycarbonate, polyimide, polythelene, or a metal material. In one embodiment, the insert may be formed in an injection molded process. In one embodiment, the material may be reinforced with glass or carbon fibers. In one embodiment, the body portion 610 of the insert 400, 600, 715, 800, 830, 870 may be tapered to allow for easier installation and a tighter fit between the cross member 415, 615, 705 and the insert 400, 600, 715, 800, 830, 870.

Figure 10A:
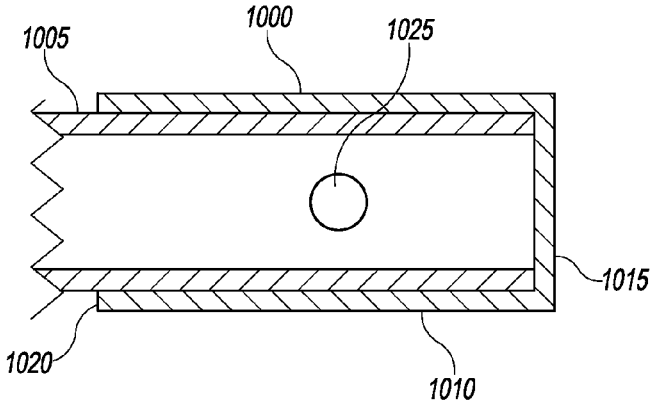
FIG. 10A illustrates a front section view of the close end of a cross member with a sleeve installed.
Figure 10B:
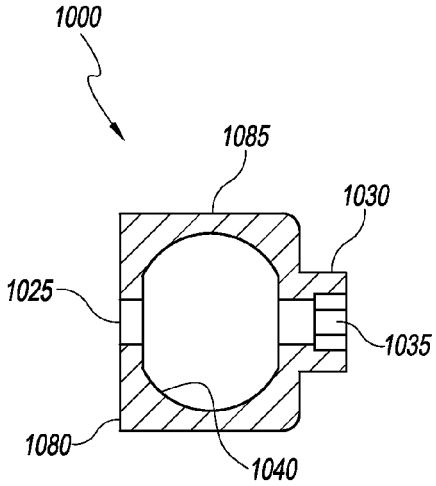
FIG. 10B illustrates a cross section view of the sleeve.
Figure 10C:
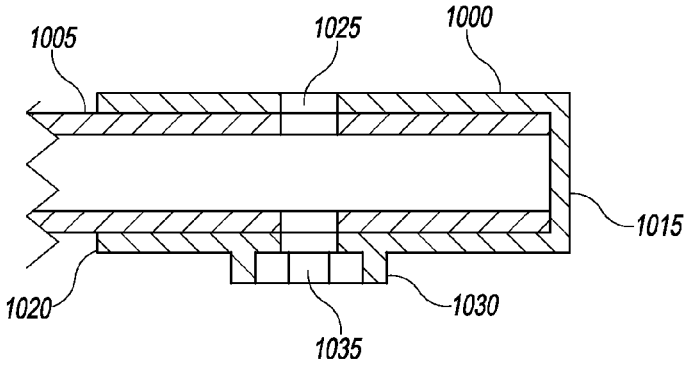
FIG. 10C illustrates a top section view of a cross member with a sleeve installed.

FIG. 10A illustrates a front section view of the close end of a cross member 1005 with a sleeve 1000 installed. FIG. 10B illustrates a cross section view of the sleeve 1000. FIG. 10C illustrates a top section view of a cross member 1005 with a sleeve 1000 installed. In one embodiment, the sleeve 1000 comprises a shell portion 1010, an open portion 1020, and a cap portion 1015. The shell portion 1010 comprises a tube like structure configured to fit over the top of the close end of the cross member 1005. The shape and dimension of the inner surface of the shell portion 1010 of the sleeve 1000 is configured to be substantially similar to that of the outer surface of the cross member 1005, providing a secure fit. The open portion 1020 allows the sleeve 1000 to be slid over the close end of the cross member 1005. The cap portion 1015 prevents the sleeve 1000 from travelling past a preferred position on the cross member 1005. The shell portion 1010 of the sleeve 1000 has a hole 1025 formed therethrough aligned with the hole 215 in the cross member 1005 to allow a fastener 725 to pass through both the cross member 1005 and the sleeve 1000. In some embodiments, the sleeve 1000 is configured to fit over an extended cross member as illustrated in FIGS. 2B and 3B.

In one embodiment, the shell portion 1010 of the sleeve 1000 comprises two long sides 1080 and two short sides 1085. In some embodiments, the sleeve 1000 also includes a receiver portion 1030 located on one of the long sides 1080 of the sleeve 1000 with a cavity 1035 formed therein to receive a retaining member 730. The cavity 1035 is aligned with the hole 1025 formed in the sleeve as well as the hole 215 formed in the cross member 1005. In one embodiment, the retaining member 730, illustrated in FIG. 7, comprises a nut having an annular body with a threaded internal surface configured to couple with the threaded surface of the fastener 725 and an outer surface comprising plurality of flat surfaces (not illustrated). In one embodiment, the internal surface of the cavity 1035 may be shaped to compliment the outer surface of the retaining member 730, for example, it may comprise a plurality of flat surfaces to lock the retaining member 730 in place, thus allowing more efficient installation of the fastener 725 and retaining member 730 to the link point 200 and quicker assembly of the canopy frame 100. In other embodiments, the retaining member 730 may retain the fastener through other means, for example a circlip, a locking ring, a rivet assembly, or a friction fit. In another embodiment, the receiver portion 1030 of the sleeve may have a threaded inner surface configured to couple with the threaded surface of the fastener (not illustrated). In some embodiments, the sleeve 1000 can include a spacer in the form of a spacing projection (not shown) with a structure similar to that of the receiver portion 1030. The spacing projection can be located about the fastener to serve as a spacer between the two cross members. The dimensions of this spacing projection can be similar to the dimensions of the spacers described herein.

Figure 11:
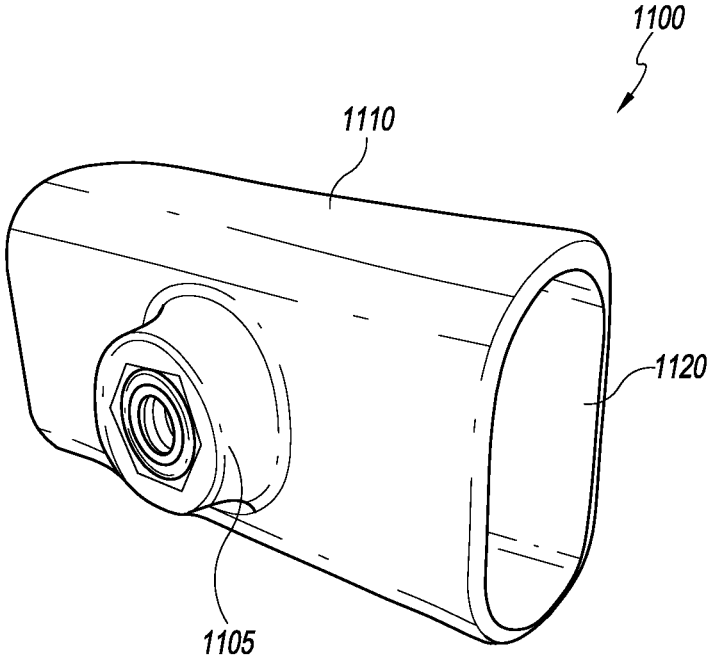
FIG. 11 illustrates a perspective view of one embodiment of a sleeve.

FIG. 11 illustrates a perspective view of one embodiment of a sleeve 1100, which can be the same as or similar to the sleeve 1000. In one embodiment, the sleeve 1100 comprises a shell portion 1110, an open portion 1120, a cap portion (not illustrated), and a receiver portion 1105. The sleeve 1100 provides increased aesthetic appeal of the canopy frame. In one embodiment, the sleeve 1100 can decrease the amount of friction at the link point and increase the ease of expansion and collapse of the canopy frame. In one embodiment, the sleeve 1100 can cover sharp edges on the ends of the cross member 1005 and/or on the fastener 725 and retaining member 730, preventing user injury or tearing of the canopy cover.

Figure 12A:
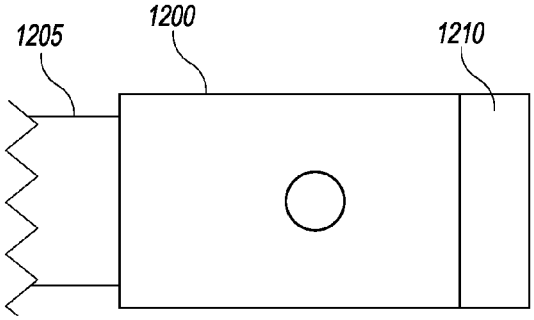
FIG. 12A illustrates a front view of a sleeve installed on a cross member.
Figure 12B:
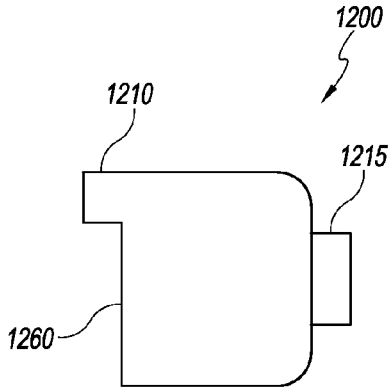
FIG. 12B illustrates a side view of a sleeve.
Figure 12C:
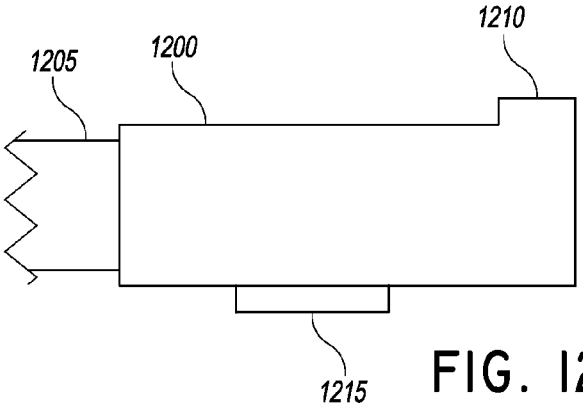
FIG. 12C illustrates a top view of a sleeve installed on a cross member.

FIG. 12A illustrates a front view of a sleeve 1200 installed on a cross member 1205. FIG. 12B illustrates a side view of a sleeve 1200. FIG. 12C illustrates a top view of a sleeve 1200 installed on a cross member 1205. In one embodiment, the sleeve 1200 comprises a projection 1210 on the long side 1260 of the sleeve 1200 and located at a location spaced a significant distance from the hole 215, such as at or near the end of the sleeve 1200 closest to the tip 230 of the cross member 1205. In one embodiment, the projection 1210 is formed as one piece with the sleeve 1200. In another embodiment, the projection 1210 may be a separate piece attached to the sleeve 1200.

Figure 13:
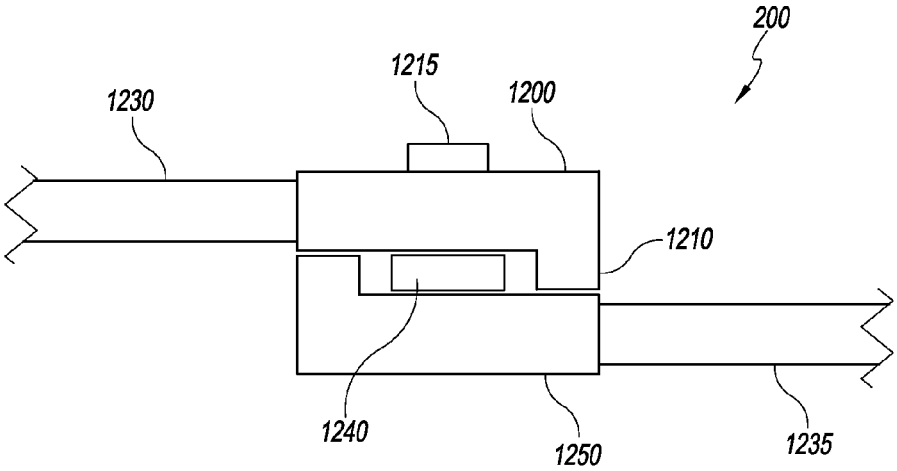
FIG. 13 illustrates a link point with a left cross member and a right cross member with sleeves installed on each.

FIG. 13 illustrates a link point 200 with a left cross member 1230 and a right cross member 1235 with sleeves 1200, 1250 installed on each and a spacer 1240. In one embodiment, one sleeve 1200 comprises a receiver portion 1215 and one sleeve 1250 does not. In one embodiment, the projections 1210 are configured to bridge some or all of the gap between the left cross member 1230 and the right cross member 1235, thus decreasing the amount of misalignment possible at the link point 200 and thus the misalignment angle 305 between the left cross member 1230 and right cross member 1235 when the canopy frame 100 is in an expanded state. The decreased amount of misalignment reduces the stress at the link point 200, thus increasing the structural integrity of the canopy frame 100 and reducing the chance of deformation, weakening, or failure of the link point 200. In some embodiments, the projection of the left cross member is offset a different distance from the axis of the hole than the projection of the right cross member to avoid interference in a collapsed state (not illustrated). In one embodiment, the projection is configured to bridge only a portion of the gap between the left cross member and the right cross member so that the projections can overlap with little or no interference (not illustrated). In another embodiment, the projection of the left cross member and the projection of the right cross member could have complementary shapes to allow for little or no interference when the canopy frame is in an expanded or collapsed state (not illustrated).

Figure 14:
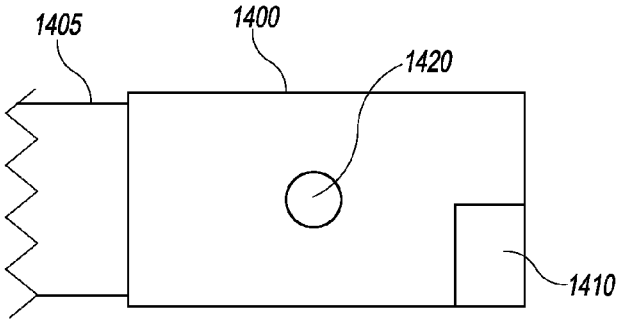
FIG. 14 illustrates a left cross member with a sleeve installed. In one embodiment, the projection may only span a portion of the long side of the sleeve.
Figure 15A:
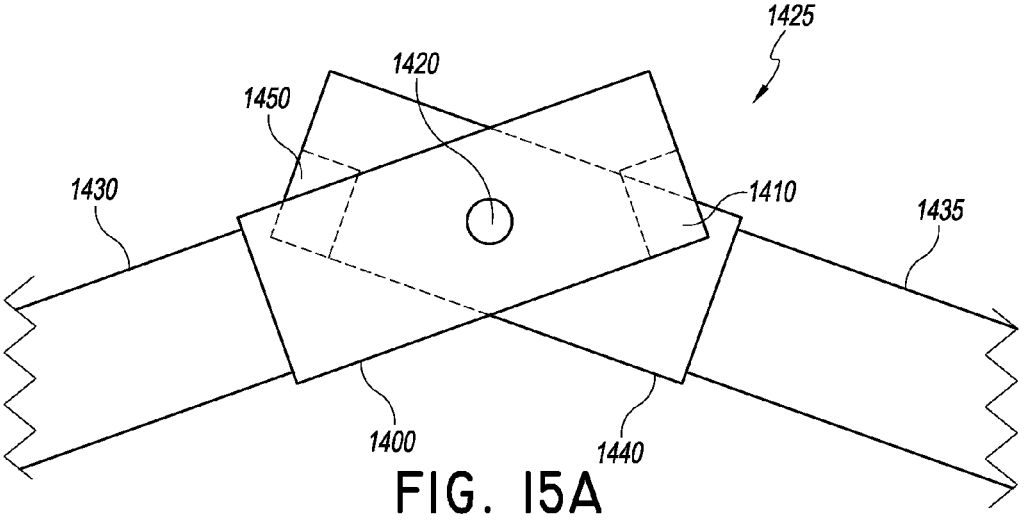
FIG. 15A illustrates a link point with a left cross member and a right cross member with sleeves installed on each in an expanded state.
Figure 15B:
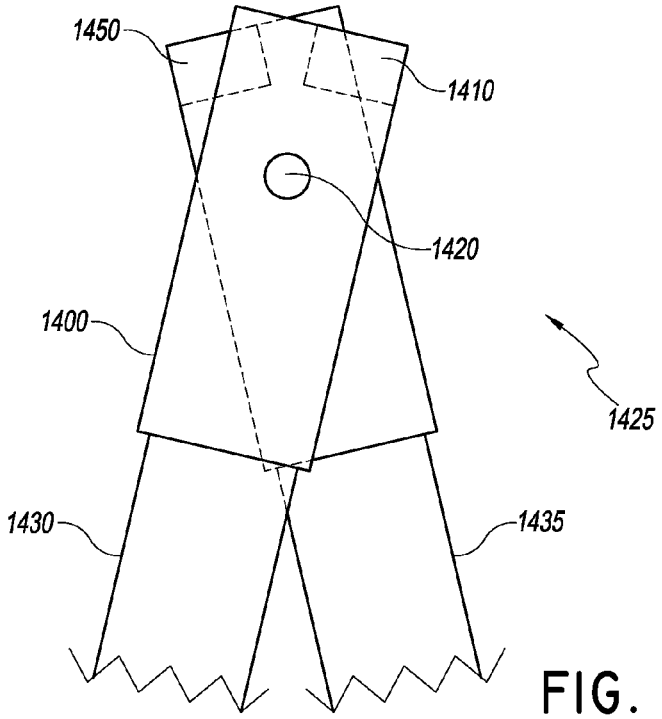
FIG. 15B illustrates a link point with a left cross member and a right cross member with sleeves installed on each in a near collapsed state.

FIG. 14 illustrates a cross member 1405 with a partial projection sleeve 1400 installed. In one embodiment, the partially spanning projection 1410 may only span a portion of the long side 1260 of the sleeve 1400. FIG. 15A illustrates a link point 1425 with a left cross member 1430 and a right cross member 1435 with partial projection sleeves 1400, 1440 installed on each in an expanded state. FIG. 15B illustrates a link point 1425 with a left cross member 1430 and a right cross member 1435 with partial projection sleeves 1400, 1440 installed on each in a near collapsed state. The partially spanning projection 1410 on the partial projection sleeve 1400 of the left cross member 1405 is configured to bridge some or all of the gap between the left cross member 1430 and the right cross member 1435 in an expanded state and allow the canopy frame 100 to achieve a collapsed state without having the partially spanning projection 1410 on the partial projection sleeve 1400 of the left cross member 1430 interfere with the partially spanning projection 1450 on the partially projecting sleeve 1440 of the right cross member 1435. In one embodiment, the partially spanning projections 1410, 1450 are configured to interact once the canopy frame 100 is in a fully collapsed state and prevent the cross members 1430, 1435 from extending past the desired link point angle 125 in a collapsed state and increases the structural rigidity of the canopy frame 100 for transport.

In some embodiments, the sleeve, such as sleeves 1000, 1200, need not extend from the end of the cross member towards a hole of the cross member. The sleeve can have many of the same features of the sleeve such as the above-described projections.

In one embodiment, the insert and sleeve may be used together. In another embodiment the spacer may be incorporated into the structure of the sleeve. In one embodiment, the sleeve may be constructed of an assortment of materials, for example, rubber, plastic, thermoplastic, thermoset, acrylonitrile butadiene styrene, polycarbonate alloy, acetal, acrylic, nylon, polybutylene terephthalate, polyester liquid crystal polymer, polypropylene, polycarbonate, polyimide, polythelene, or a metal material. In one embodiment, the insert may be formed in an injection molded process. In one embodiment, the material may be reinforced with glass or carbon.

Figure 16A:
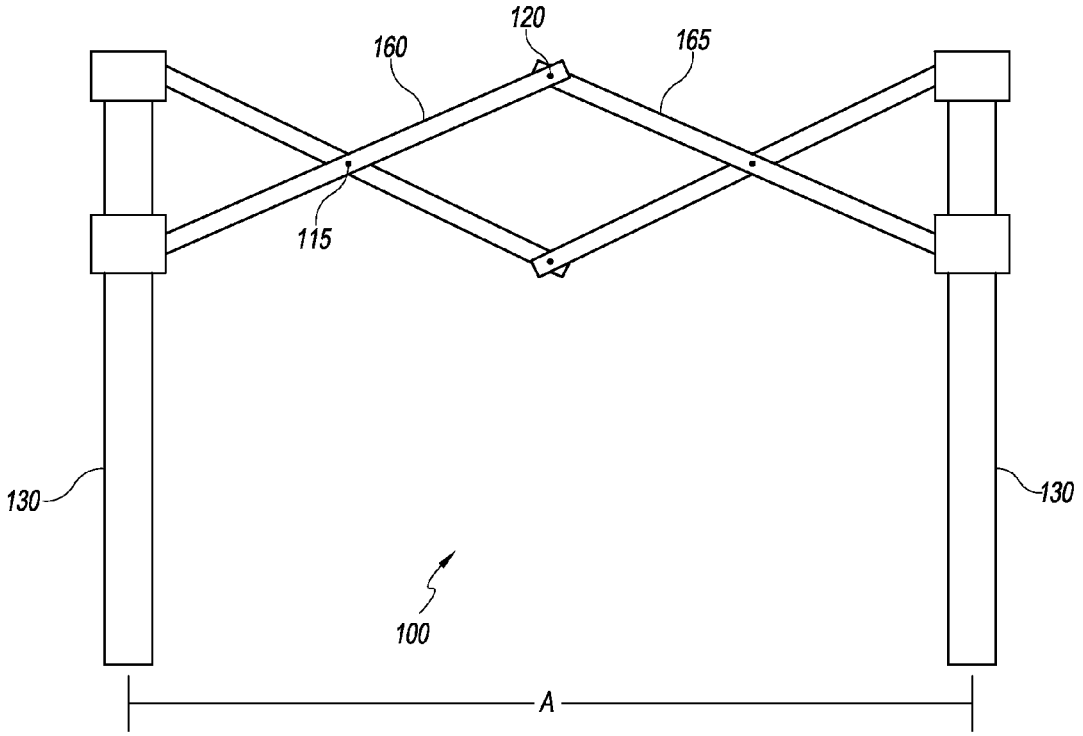
FIG. 16A illustrates a front plan view of one type of collapsible canopy frame in an expanded position.
Figure 16B:
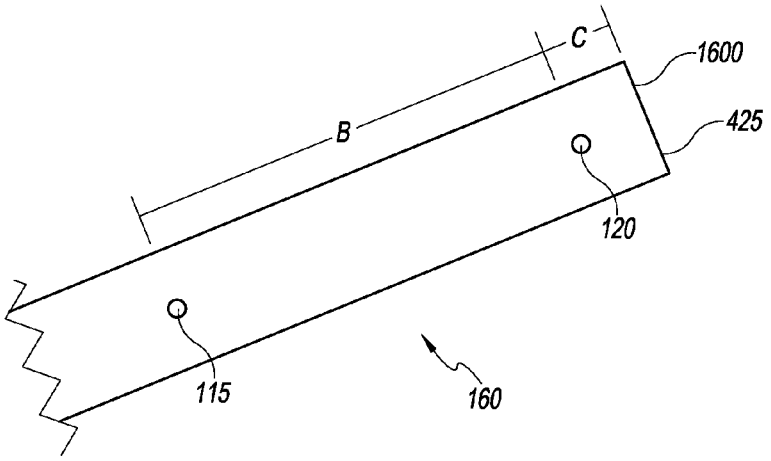
FIG. 16B illustrates a front plan view of the left cross member of the collapsible canopy frame of FIG. 16A.

FIG. 16A illustrates a front plan view of one type of collapsible canopy frame 100 in an expanded position. FIG. 16B illustrates a front plan view of the left cross member 160 of the collapsible canopy frame 100 of FIG. 16A. In some embodiments, the size A of a canopy frame can be described by the distance between the poles 130 of the collapsible canopy frame 100. In some embodiments, the collapsible canopy frame 100 is square in shape and can comprise a standard size such as 8'×8', 10'×10', 12'×12', etc. In some embodiments, the length B of a cross member is defined as the length between the center of the hole of the cross point 115 and the center of the hole 215 of the link point 120. In some embodiments, the overlap distance C is defined as the distance between the center of the hole 215 of the link point 120 and the furthest overlapping surface 1600 of the cross member, measured along the centerline 1710, 1720 of the cross member 160, 165, as illustrated in FIGS. 16B-18B and 20.

Figure 20:
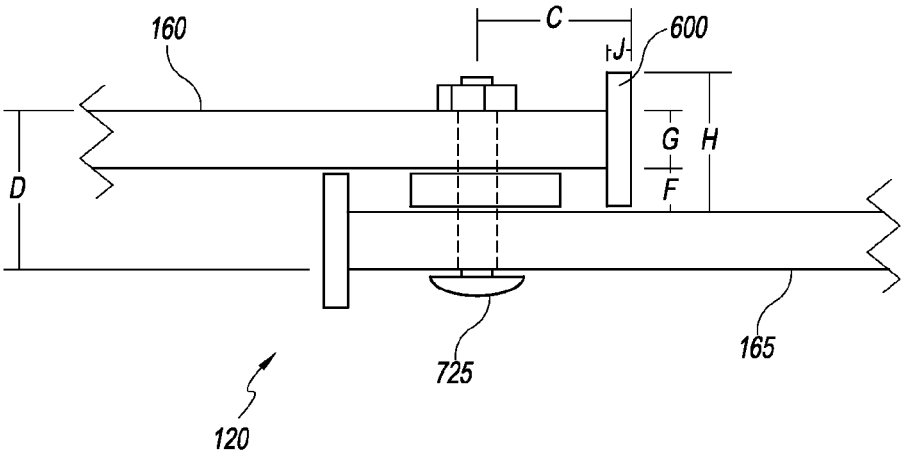
FIG. 20 illustrates a top view of a link point with enlarged head inserts installed in the cross members.

In some embodiments, as described above, a collapsible canopy frame 100 may utilize an insert 400, 600, 715, 800, 830, 870 or sleeve 1000, 1100, 1200, 1400 installed into or onto the cross member 160, 165. If the collapsible canopy frame 100 does not utilize an insert 400, 600, 715, 800, 830, 870 or sleeve 1000, 1100, 1200, 1400, as illustrated in FIG. 16A-17B, the furthest overlapping surface 1600 comprises the tip 425 of each cross member 160, 165. If the collapsible canopy frame 100 does utilize an insert 400, 600, 715, 800, 830, 870, sleeve 1000, 1100, 1200, 1400, or any additional feature which extends the length of the cross member 160, 165, as illustrated in FIG. 20, the furthest overlapping surface 1600 comprises the surface of the insert 400, 600, 715, 800, 830, 870, sleeve 1000, 1100, 1200, 1400, or additional feature installed into the cross member which is furthest from the hole 215 of the link point 200.

In some embodiments, the distance B can be between about 300 millimeters and about 600 millimeters, between about 400 millimeters to about 500 millimeters, about 400 millimeters, about 450 millimeters, and any other distance therebetween. In some embodiments, the distance C can be between about 20 millimeters to about 80 millimeters, between about 30 millimeters to about 70 millimeters, between about be about 40 millimeters to about 60 millimeters.

In some embodiments, the overlap distance C of the cross member 160, 165 can be related to the size A of the collapsible canopy frame. Without being bound by any particular theory, the larger the size A of the canopy frame, the greater the potential bending moments about the link point. Accordingly, a greater overlap distance C can be used to counteract the potentially more significant bending moments. In some embodiments, the ratio of the size of the collapsible canopy frame A to the overlap distance C can be less than about 100 to 1, less than about 80 to 1, less than about 60 to 1. In some embodiments, the overlap distance C can be related to the length B of the cross member 160, 165. Without being bound by any particular theory, the greater the length B, the greater the potential bending moment about the link point. Accordingly, a greater overlap distance C can be used to counteract the more significant bending moment by creating a longer lever arm. In some embodiments, the ratio of the length B of the cross member 160, 165 to the overlap distance C can be less than about 200 to 1, less than about 150 to 1, less than about 130 to 1, less than about 100 to 1, less than about 70 to 1. Larger overlap distances C offer many advantages as described above by decreasing the amount of misalignment possible and decreasing stress at the link point 120 and increasing the structural integrity of the collapsible canopy frame 100.

Figure 17A:
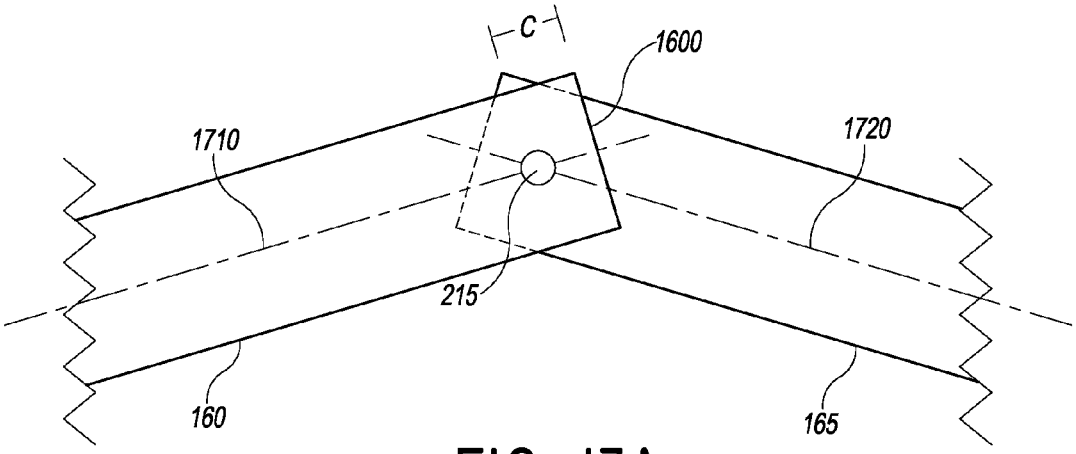
FIGS. 17A and 17B illustrate front plan views of a left cross member and a right cross member pivotally coupled at a link point.
Figure 17B:
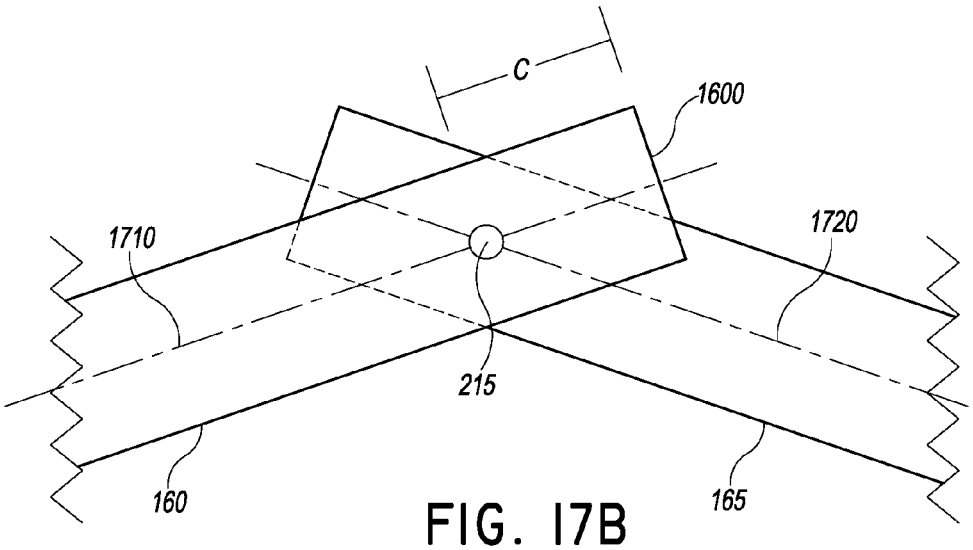

FIGS. 17A and 17B illustrate front plan views of a left cross member 160 and a right cross member 165 pivotally coupled at a link point. The left cross member centerline 1710 runs along the center axis of the left cross member 160 and the right cross member centerline 1720 runs along the center axis of the right cross member 165. In some embodiments, when viewed from a plan view, the overlap distance C is not large enough such that when the collapsible canopy frame 100 is in an expanded state, the entire furthest overlapping surface 1600 does not extend beyond the centerline of the opposite cross member, as illustrated in FIG. 17A. In some embodiments, when viewed from a plan perspective, the overlap distance C is large enough such that when the collapsible canopy frame 100 is in an expanded state, the entire furthest overlapping surface 1600 extends beyond the centerline of the opposite cross member, as illustrated in FIG. 17B. In some embodiments, when viewed from a plan perspective, the overlap distance C is large enough such that when the collapsible canopy frame 100 is in an expanded state, at least 50% of the furthest overlapping surface 1600 extends beyond the centerline of the opposite cross member. In some embodiments, when viewed from a plan perspective, the overlap distance C is large enough such that when the collapsible canopy frame 100 is in an expanded state, at least 75% of the furthest overlapping surface 1600 extends beyond the centerline of the opposite cross member.

In some embodiments, when viewed from a plan view, a portion of the furthest overlapping surface 1600 of the left cross member 160 overlaps with the right cross member 165 when the collapsible canopy frame 100 is in an expanded state, as illustrated in FIGS. 17A-B. In some embodiments, when viewed from a plan view, a portion of the furthest overlapping surface 1600 of a cross member overlaps with the opposite cross member at a link point 120 when the collapsible canopy frame 100 is in an expanded state, as illustrated in FIGS. 17A-B. In some embodiments, when viewed from a plan view, less than 90% of the furthest overlapping surface 1600 of a cross member overlaps with the opposite cross member at a link point 120 when the collapsible canopy frame 100 is in an expanded state. In some embodiments, when viewed from a plan view, less than 80% of the furthest overlapping surface 1600 of a cross member overlaps with the opposite cross member at a link point 120 when the collapsible canopy frame 100 is in an expanded state. In some embodiments, when viewed from a plan view, less than 70% of the furthest overlapping surface 1600 of a cross member overlaps with the opposite cross member at a link point 120 when the collapsible canopy frame 100 is in an expanded state. In some embodiments, when viewed from a plan view, less than 60% of the furthest overlapping surface 1600 of a cross member overlaps with the opposite cross member at a link point 120 when the collapsible canopy frame 100 is in an expanded state. In some embodiments, when viewed from a plan view, less than 50% of the furthest overlapping surface 1600 of a cross member overlaps with the opposite cross member at a link point 120 when the collapsible canopy frame 100 is in an expanded state. In some embodiments, when viewed from a plan view, less than 40% of the furthest overlapping surface 1600 of a cross member overlaps with the opposite cross member at a link point 120 when the collapsible canopy frame 100 is in an expanded state. In some embodiments, when viewed from a plan view, less than 30% of the furthest overlapping surface 1600 of a cross member overlaps with the opposite cross member at a link point 120 when the collapsible canopy frame 100 is in an expanded state. In some embodiments, when viewed from a plan view, less than 20% of the furthest overlapping surface 1600 of a cross member overlaps with the opposite cross member at a link point 120 when the collapsible canopy frame 100 is in an expanded state. In some embodiments, when viewed from a plan view, less than 10% of the furthest overlapping surface 1600 of a cross member overlaps with the opposite cross member at a link point 120 when the collapsible canopy frame 100 is in an expanded state.

Figure 18A:
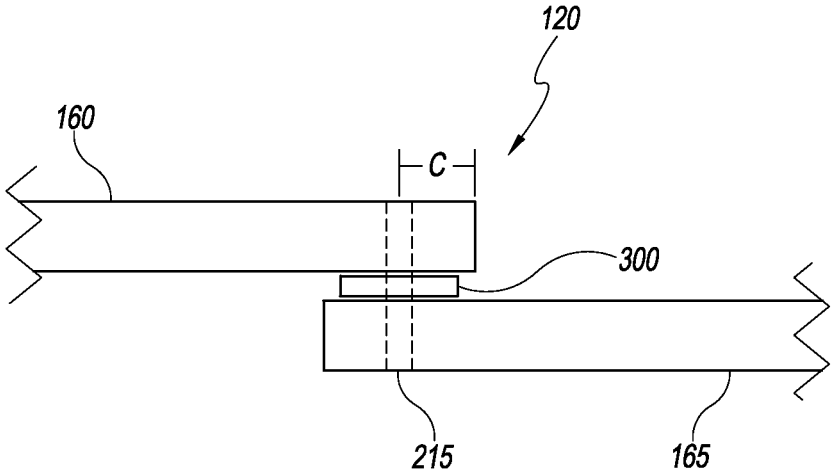
FIGS. 18A and 18B illustrate top views of a link point.
Figure 18B:
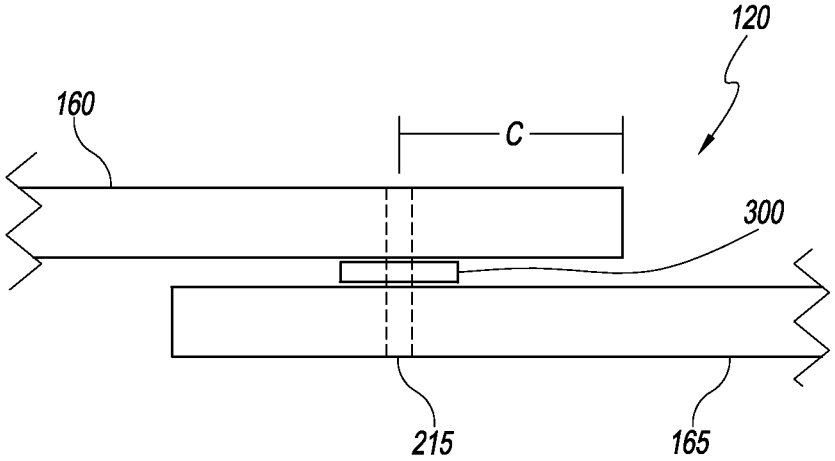

FIGS. 18A and 18B illustrate top views of a link point 120. In some embodiments, the overlap distance C can be shorter, as illustrated in FIG. 18A, or longer, as illustrated in FIG. 18B. In some embodiments, the link point thickness D comprises the thickness of each cross member 160, 165 as well as the spacing distance F between the two cross members. In some embodiments, the spacing distance F can be the thickness of the spacer 300 between them, as illustrated in FIGS. 18A-B. As discussed above, in some embodiments, the spacer 300 can have a thickness between about 0.1 millimeters to about 2.0 millimeters, between about 0.3 millimeters to about 1.5 millimeters, about 1.5 millimeters, about 0.5 millimeters, and any other thickness therebetween. However, as should be apparent, the spacing distance F can also be the result of the use of a sleeve or other device which can add additional spacing distance F between the two cross members. As such, the link point thickness D also comprises any additional spacers, sleeves, or inserts, which increase the link point thickness D.

In some embodiments, the overlap distance C can be related to the link point thickness "D," measured along the axis of the hole 215 of the link point 120. The ratio of the overlap distance C to the link point thickness D can be greater than about 2 to 1, greater than about 3 to 1, greater than about 4 to 1, greater than about 5 to 1, or greater than about 6 to 1. In some embodiments, the ratio of the overlap distance C to the spacing distance F can be greater than about 10 to 1, greater than about 50 to 1, greater than about 100 to 1, greater than about 150 to 1. In some embodiments, the ratio of the overlap distance C to the spacing distance F can be between about 50 to 1 to about 200 to 1, between about 60 to 1 to about 120 to 1, and any other ratio between these ranges.

In some embodiments, the overlap distance C can be related to the radius of the spacer 300. As discussed above, in some embodiments, the outer radius of the spacer 300 can be between about 5 millimeters to 15 millimeters, between about 5 millimeters to about 10 millimeters, about 6.5 millimeters, about 7 millimeters, or any other outer radius within these ranges. In some embodiments, the ratio of the overlap distance C to the radius of the spacer 300 can be greater than about 3 to 1, greater than about 5 to 1, greater than about 8 to 1, greater than about 12 to 1. In some embodiments, the ratio of the overlap distance C to the radius of the spacer can be between about 4 to 1 to about 10 to 1, between about 6 to 1 to about 8 to 1, and any other ratio between this range.

In some embodiments, the overlap distance C can be related to the thickness of the spacer 300. As discussed above, in some embodiments, the spacer 300 can have a thickness between about 0.1 millimeters to about 2.0 millimeters, between about 0.3 millimeters to about 1.5 millimeters, about 1.5 millimeters, about 0.5 millimeters, and any other thickness therebetween. In some embodiments, the ratio of the overlap distance C to the thickness of the spacer 300 can be greater than about 10 to 1, greater than about 50 to 1, greater than about 100 to 1, greater than about 150 to 1. In some embodiments, the ratio of the overlap distance C to the thickness of the spacer can be between about 50 to 1 to about 200 to 1, between about 60 to 1 to about 120 to 1, and any other ratio between these ranges.

Figure 19A:
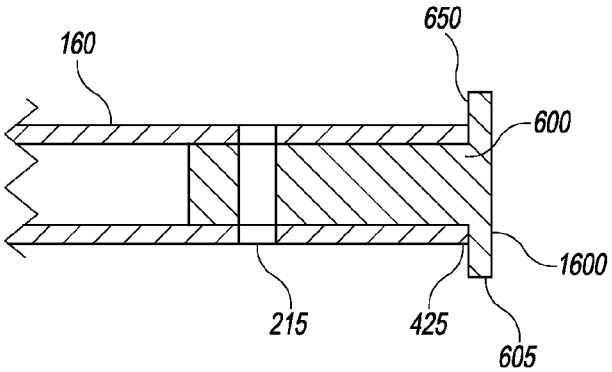
FIG. 19A illustrates a top section view looking towards a short side of a cross member and enlarged head insert.
Figure 19B:
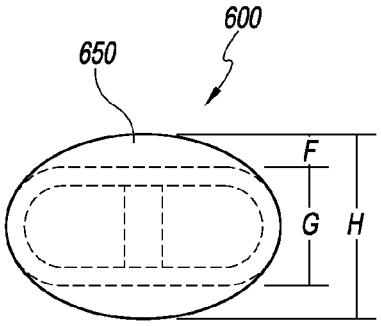
FIG. 19B illustrates an end view of an enlarged head insert.

FIG. 19A illustrates a top section view looking towards a short side of a cross member and enlarged head insert 600. FIG. 19B illustrates an end view of an enlarged head insert 600. FIG. 20 illustrates a top view of a link point 120 with enlarged head inserts 600 installed in the cross members. In some embodiments, as discussed above, a spacer 300 is incorporated into the link point 120 to reduce the level of friction created by the link point 120 and allow the cross members 160, 165 to pivot freely. In some embodiments, a collapsible canopy frame 100 must incorporate both a spacer 300 and an insert 400, 600, 715, 800, 830, 870 or sleeve 1000, 1100, 1200, 1400 comprising a projection 1210, 1410 or extension 650. In some embodiments, the head portion of the enlarged head insert 600 extends beyond the outer surface of the cross member 160, 165 as described above, decreasing the amount of misalignment possible and thus the misalignment angle between the left cross member 160 and right cross member 165 when the collapsible canopy frame 100 is in an expanded state. The portions of the enlarged head insert 600 which extend beyond the outer surface of the cross member are referred to as extensions 650. In some embodiments, the extensions 650 can extend an extension distance F beyond the outer surface of the cross member 160, 165, as illustrated in FIGS. 19B and 20. In some embodiments, the cross member 160 can comprise a cross member thickness G, as illustrated in FIGS. 19B and 20. In some embodiments, the head portion 605 of the enlarged head insert 600 comprises a head portion thickness H, as illustrated in FIGS. 19B and 20. In some embodiments, extension distance F and head portion thickness H can also apply to a sleeve (not illustrated). In some embodiments, the projections 1210, 1410 of a sleeve 1000, 1100, 1200, 1400, as illustrated in FIG. 13, can extend an extension distance F from the outer surface of the cross member (not illustrated). In some embodiments, the portion of the sleeve 1000, 1100, 1200, 1400 comprising a projection 1210, 1410, can comprise a head portion thickness H. In some embodiments, a collapsible canopy frame 100 must incorporate both a spacer 300 and an insert 400, 600, 715, 800, 830, 870 or sleeve 1000, 1100, 1200, 1400 comprising a projection 1210, 1410 or extension 650.

In some embodiments, the extension distance F of an insert or sleeve can be between about 0.5 millimeters to about 10 millimeters, between about 1 millimeter to about 5 millimeters, about 1 millimeter, about 1.25 millimeters, about 1.5 millimeters, and any other distance within this range.

In some embodiments, the thickness of the cross member G can be between about 8 millimeters to about 30 millimeters, between about 10 millimeters to about 20 millimeters, about 10 millimeters, about 12 millimeters, about 15 millimeters, about 20 millimeters, and any other thickness within this range.

In some embodiments, the head portion thickness H can be approximately 12.5 mm. In some embodiments, the head portion thickness H can be between approximately 12 to 13 mm. In some embodiments, the head portion thickness H can be between approximately 11 to 14 mm. In some embodiments, the head portion thickness H can be between approximately 10 to 15 mm. In some embodiments, the head portion thickness H can be between approximately 8 to 20 mm. In some embodiments, the head portion thickness H can be greater than approximately 10 mm. In some embodiments, the head portion thickness H can be greater than approximately 12 mm. In some embodiments, the head portion thickness H can be greater than approximately 14 mm.

In some embodiments, the extension thickness J can be chosen to alter the characteristics of the device. In some embodiments, the extension thickness can be between about 1 millimeter to about 30 millimeters, can be between about 2 millimeters to about 20 millimeters, can be about 2.5 millimeters, can be about 10 millimeters, can be about 20 millimeters, and any other extension thickness within this range. The extension thickness J can be chosen, for example, so that a sufficient amount of friction is applied to when in a collapsed and expanded state by increasing the potential contact area between the extension and the opposing cross member. As should be apparent, this is applicable in embodiments where the extension contacts the cross-member in a collapsed and expanded state. This can reduce the likelihood that the cross members will shift from the collapsed and expanded states due to forces applied to the canopy.

In some embodiments, the extension distance F can be related to the thickness of the spacer 300. In some embodiments, the extension distance F can be less than half of the thickness of the spacer 300. In some embodiments, the extension distance F can be approximately half the thickness of the spacer 300. In some embodiments, the extension distance F can be greater than half the thickness of the spacer 300. In some embodiments, the extension distance F can be less than the thickness of the spacer 300. In some embodiments, the extension distance F can be approximately the thickness of the spacer 300. In some embodiments, the extension distance F can be slightly greater than the thickness of the spacer 300.

In some embodiments, the extension distance F can be related to the diameter of the fastener 725. The diameter of the fastener 725 comprises the diameter of the body portion of the fastener 725 which passes through the holes 215 of the cross members 160, 165 as well as the spacer 300. In some embodiments, the fastener 725 is a standard size fastener, which may include for example a 6 mm fastener. In some embodiments, the ratio of the extension distance F to the diameter of the fastener 725 can be between about 1 to 10 to about 4 to 1, between about 1 to 8 to about 2 to 1, between about 1 to 8 to about 1 to 1, approximately 1 to 5, approximately 1 to 4, approximately 1 to 2, approximately 1, and any other ratio between these ranges.

In some embodiments, the overlap distance C can be related to the diameter of the fastener 725. In some embodiments, the ratio of the overlap distance C to the diameter of the fastener 725 can be between about 20 to 1 to about 2 to 1, between about 10 to 1 to about 5 to 1, about 5 to 1, about 7 to 1, about 10 to 1, and any other ratio between these ranges.

In some embodiments, the diameter of the fastener 725 may be slightly smaller than the standard size indicated. In some embodiments, the diameter of the holes 215 in the cross members 160, 165 or in the spacer 300 may not match the diameter of the fastener. The diameter of the fastener 725 may be smaller than the holes 215 in the cross members 160, 165 or in the spacer 300. This can lead to additional play and misalignment at the link point 120.

While the ratios and dimensions discussed above in connection with FIGS. 16A-20 were generally described with reference to an insert, it should be appreciated that these dimensions can also be applicable to any of the sleeves described herein such as sleeves with projections and/or spacing projections.

Figure 21A:
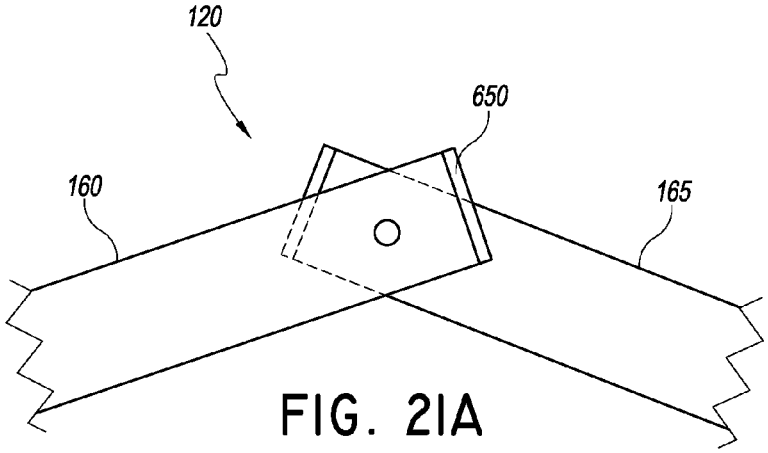
FIGS. 21A-C illustrate front plan views of a left cross member and a right cross member pivotally coupled at a link point during varying stages of expansion of the collapsible canopy frame.
Figure 21B:
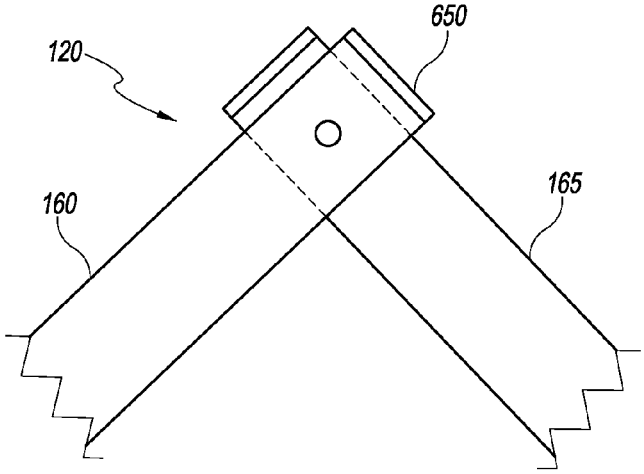
Figure 21C:
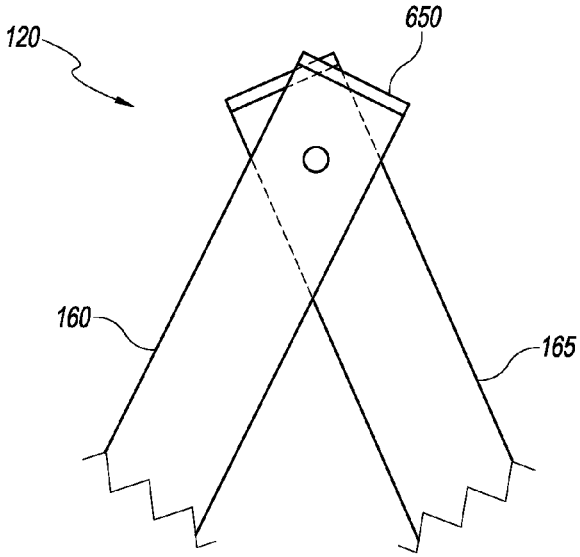

FIGS. 21A-C illustrate front plan views of a left cross member 160 and a right cross member 165 pivotally coupled at a link 120 point during varying stages of expansion of the collapsible canopy frame 100. FIG. 21A illustrates a link point when the collapsible canopy frame 100 is in a substantially expanded state. FIG. 21B illustrates a link point when the collapsible canopy frame 100 is in a partially expanded state. FIG. 21C illustrates a link point 120 when the collapsible canopy frame 100 is a substantially collapsed state. In some embodiments, the collapsible canopy frame 100 is configured such that the extensions 650 or projections 1210, 1410 only contact the opposite cross member, insert 400, 600, 715, 800, 830, 870 or sleeve 1000, 1100, 1200, 1400 of the link point 120 when the collapsible canopy frame 100 is in a substantially expanded state, as illustrated in FIG. 21A, and a substantially collapsed state as illustrated in FIG. 21C, but not in a partially expanded state between a substantially expanded state and a substantially expanded state, as illustrated in FIG. 21B. In order for a collapsible canopy frame 100 to be capable of achieving a partially expanded state wherein the extensions or projections do not contact the opposite cross member, insert 400, 600, 715, 800, 830, 870 or sleeve 1000, 1100, 1200, 1400 of the link point 120, as illustrated in FIG. 21B, the extension or projection must completely clear the opposite cross member, insert 400, 600, 715, 800, 830, 870 or sleeve 1000, 1100, 1200, 1400 of the link point 120 during at least a portion of the range of motion of the link point during expansion or collapse of the collapsible canopy frame.

In some embodiments, a collapsible canopy frame 100 capable of achieving a partially expanded state, such as the collapsible canopy frame illustrated in FIGS. 21A-21C, offers several advantages. It may be preferable for a collapsible canopy frame 100 to remain in an expanded state when deployed or to remain in a collapsed state for storage and transport. It may also be preferable for a collapsible canopy frame 100 to be easily converted from a collapsed state to an expanded state and vice versa. In some embodiments, a collapsible canopy frame 100 achieving a partially expanded state as described above, can be easy to rotate when in an a partially expanded state, as the extensions 650 or projections 1210, 1410 are not contacting the opposite cross member, insert 400, 600, 715, 800, 830, 870 or sleeve 1000, 1100, 1200, 1400 of the link point 120, but can be more difficult to rotate when in a substantially expanded state or in a substantially collapsed state as the extensions 650 or projections 1210, 1410 can contact the opposite cross member, insert 400, 600, 715, 800, 830, 870 or sleeve 1000, 1100, 1200, 1400 of the link point 120.

In some embodiments, the fastener 725 in the link point 120 may not be torqued down as tightly as desirable, minimizing the amount of friction created at the link point 120 and facilitating easier expansion and collapse of the collapsible canopy frame 100. Such below desirable fastener torqueing however can lead to additional misalignment of the cross members 160, 165 of the link point 120. In some embodiments, a collapsible canopy frame 100 achieving a partially expanded state as described above, can be easy to rotate when in an a partially expanded state, as the fastener 725 is not torqued down as tightly as desirable, however when in a substantially expanded state, especially when the extension distance F of the extensions 650 or projections 1210, 1410 are at least as large as the thickness of the spacer 300, the extensions 650 or projections 1210, 1410 can contact the opposite cross member, insert 400, 600, 715, 800, 830, 870 or sleeve 1000, 1100, 1200, 1400, taking up any slack in the link point 120 and increasing stiffness and reduce misalignment in the joint.

In some embodiments, especially when the extension distance F of the extensions 650 or projections 1210, 1410 is at least half the thickness of the spacer 300, the extensions 650 or projections 1210, 1410 of opposite cross members of a link point 120 can interfere with one another when in a substantially collapsed state. In some embodiments, the extensions 650 or projections 1210, 1410 of each opposite cross member of a link point 120 can be offset different distances, such that they do not interfere with one another when the collapsible canopy frame 100 is in a substantially collapsed state because the extension 650 or projection 1210, 1410 of one cross member is further from the hole 215 of the link point 120 than the extension 650 or projection 1210, 1410 of the opposite cross member. In some embodiments, the tip distance of each opposite cross member could be different, such that when utilizing inserts 400, 600, 715, 800, 830, 870 or sleeves 1000, 1100, 1200, 1400 the extensions 650 or projections 1210, 1410 do not interfere with one another when the collapsible canopy frame 100 is in a substantially collapsed state. In some embodiments, the tip distance of each opposite cross member could be similar, but the inserts 400, 600, 715, 800, 830, 870 or sleeves 1000, 1100, 1200, 1400 of each opposite cross member of the link point 120 could incorporate a different offset, such that the extensions 650 or projections 1210, 1410 of each opposite cross member are different distances from the hole of the link point (not illustrated).

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. The word "exemplary" is used exclusively herein to mean "serving as an example, instance, or illustration." Any implementation described herein as "exemplary" is not necessarily to be construed as preferred or advantageous over other implementations. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A cross member insert system for a canopy frame having first and second cross members pivotally coupled about a link point axis, the cross member insert system comprising:

a spacer configured to be positioned in a gap between outer surfaces of the first and second cross members and about the link point axis, the spacer comprising a first surface oriented towards the first cross member and a second surface oriented towards the second cross member; and a cross member insert comprising:

a body portion comprising two long sides and two short sides, the body portion being configured to fit within the first cross member; and a head portion comprising two long sides, two short sides and an extension extending from at least one of the long sides of the head portion, the head portion being configured to abut an end of the first cross member and the extension extending past the first surface of the spacer, the extension configured to bridge a gap between the first and second cross members, the extension spaced from the link point axis.

2. The system of claim 1, wherein the body portion of the cross member insert extends to the link point axis.

3. The system of claim 2, wherein the body portion comprises a hole about the link point axis for allowing a fastener to pass therethrough.

4. The system of claim 1, wherein a distance between the link point axis and the end of the first cross member is 2 to 5 times a radius of the spacer.

5. The system of claim 1, wherein the extension does not extend to the link point axis.

6. A cross member sleeve system for a canopy frame having first and second cross members pivotally coupled about a link point axis, the cross member sleeve system comprising:

a spacer configured to be positioned between outer surfaces of the first and second cross members and about the link point axis, the spacer comprising a first surface oriented towards the first cross member and a second surface oriented towards the second cross member; and a cross member sleeve comprising:

a shell portion configured to slide over the outer surface of the first cross member, the shell portion comprising two long sides, two short sides, a first end having an opening sized to receive an end of the first cross member and a second end;

a cap portion comprising a surface extending radially inwardly to abut an end of the first cross member, the cap portion being positioned at the second end of the shell portion; and a projection extending radially outwardly from at least one of the two long sides of the shell portion, the projection extending toward the second cross member and past the first surface of the spacer, the projection configured to bridge a gap between the first and second cross members, the projection spaced from the link point axis.

7. The system of claim 6, wherein the shell portion of the cross member sleeve extends to the link point axis.

8. The system of claim 7, wherein the shell portion comprises a hole about the link point axis for allowing a fastener to pass therethrough.

9. The system of claim 6, wherein a distance between the link point axis and the end of the first cross member is 2 to 5 times a radius of the spacer.

10. The system of claim 6, wherein the projection does not extend to the link point axis.

11. The cross member sleeve system of claim 6, wherein the projection spans partially across said long side of said shell portion in a direction between the two short sides.

12. The cross member sleeve system of claim 11, wherein:

the first and second cross members form a link point angle;

the first and second cross members have a collapsed position and an expanded position, the collapsed position having a collapsed link point angle that is less than the link point angle in the expanded position; and wherein the projection is configured to interact with another cross member sleeve to inhibit rotation to a link point angle less than the collapsed link point angle.

13. The cross member sleeve system of claim 6, wherein the cross member sleeve further comprises a receiver portion extending out from an outer surface of the shell portion configured to accept a retaining member.

* * * * *